US008358961B2

(12) United States Patent
Hasegawa et al.

(10) Patent No.: US 8,358,961 B2
(45) **Date of Patent: *Jan. 22, 2013**

(54) IMAGE-BEARING MEMBER PROTECTING AGENT, PROTECTIVE LAYER FORMING DEVICE, IMAGE FORMING METHOD, IMAGE FORMING APPARATUS, AND PROCESS CARTRIDGE

(75) Inventors: Kunio Hasegawa, Isehara (JP); Hiroshi Nakai, Yokohama (JP); Shinya Tanaka, Sagamihara (JP)

(73) Assignee: Ricoh Company, Limited, Tokyo (JP)

( * ) Notice: Subject to any disclaimer, the term of this patent is extended or adjusted under 35 U.S.C. 154(b) by 512 days.

This patent is subject to a terminal disclaimer.

(21) Appl. No.: 12/654,908

(22) Filed: Jan. 8, 2010

(65) Prior Publication Data

US 2010/0183972 A1 Jul. 22, 2010

(30) Foreign Application Priority Data

Jan. 19, 2009 (JP) ..... 2009-008952

(51) Int. Cl.
*G03G 21/00* (2006.01)
*G03G 13/16* (2006.01)

(52) U.S. Cl. ..... 399/346; 430/126.2

(58) Field of Classification Search ..... 399/343, 399/346, 123; 430/30, 31
See application file for complete search history.

(56) References Cited

U.S. PATENT DOCUMENTS 3,501,294 A 3/1970 Joseph
5,173,204 A 12/1992 Chiddick et al.
5,459,019 A * 10/1995 Kato et al. ..... 430/270.11
6,060,205 A 5/2000 Takeichi et al.
2006/0063093 A1* 3/2006 Kurosu ..... 430/122
2007/0123435 A1* 5/2007 Usami ..... 508/100
2008/0118286 A1* 5/2008 Yamashita et al. ..... 399/346
2008/0138132 A1* 6/2008 Yamashita et al. ..... 399/343
2009/0142685 A1* 6/2009 Nagatomo et al. ..... 430/108.6
2009/0196665 A1 8/2009 Tanaka et al.
2009/0279930 A1 11/2009 Kabata et al.
2009/0285613 A1 11/2009 Nakai et al.
2009/0290919 A1 11/2009 Tanaka et al.
2009/0290920 A1 11/2009 Hatakeyama et al.
2009/0304423 A1 12/2009 Ozaki et al.
2009/0311014 A1 12/2009 Tanaka et al.

FOREIGN PATENT DOCUMENTS

EP 1 790 711 5/2007
EP 1 793 282 6/2007
JP 51-22380 7/1976
JP 2002-097483 4/2002
JP 2005-171107 6/2005
JP 2005-274737 10/2005
JP 2006-350240 12/2006
JP 2007-286594 11/2007

OTHER PUBLICATIONS

Extended European Search Report dated Feb. 21, 2011.

* cited by examiner

*Primary Examiner* — David Gray
*Assistant Examiner* — Thomas Giampaolo, II
(74) *Attorney, Agent, or Firm* — Harness, Dickey & Pierce, P.L.C.

(57) ABSTRACT

An image-bearing member protecting agent including: a hydrophobic organic compound (A); an inorganic lubricant (B); and inorganic fine particles (C), wherein each of the inorganic fine particles (C) has a specific surface area of 2.0 $m^2/g$ to 6.5 $m^2/g$.

20 Claims, 2 Drawing Sheets

IMAGE-BEARING MEMBER PROTECTING AGENT, PROTECTIVE LAYER FORMING DEVICE, IMAGE FORMING METHOD, IMAGE FORMING APPARATUS, AND PROCESS CARTRIDGE

BACKGROUND OF THE INVENTION

1. Field of the Invention

The present invention relates to an image-bearing member protecting agent that is applied or adhered to a surface of an image bearing member so as to protect the surface thereof, a protective layer forming device for applying or adhering the protecting agent to the surface of the image bearing member so as to form a protective layer thereon, an image forming method, an image forming apparatus and a process cartridge, using the image-bearing member protecting agent or the protective layer forming device, in an electrophotographic image forming method and image forming apparatus.

2. Description of the Related Art

Conventionally, in electrophotographic image formation, a latent electrostatic image is formed on an image bearing member made from a photoconductive material, and charged toner particles are attached to this latent electrostatic image so as to form a visible image. The visible image formed with the toner particles is transferred onto a recording medium such as paper, or the like, and then fixed on the recording medium utilizing heat, pressure, solvent gas, or the like so as to form an output image.

Methods for the image formation are broadly classified, according to methods for charging toner particles to form a visible image, into so-called two-component developing methods in which frictional charging effected by stirring and mixing toner particles and carrier particles is utilized, and so-called one-component developing methods in which toner particles are charged without using carrier particles. Further, the one-component developing methods are classified into magnetic one-component developing methods and nonmagnetic one-component developing methods, according to whether or not magnetic force is utilized to keep toner particles on a developing roller.

In image forming apparatuses, such as copiers, complex machines based upon the copiers, and the like for which high-speed processing capability and image reproducibility are required, the two-component developing methods have been employed in many cases due to demands for stable chargeability of toner particles, stable charge rising properties of the toner particles, long-term stability of image quality, and the like; whereas in compact printers, facsimiles, etc. for which space saving, cost reduction and the like are required, the one-component developing methods have been employed in many cases.

Also, nowadays in particular, colorization of output images is progressing, and demands for improvement of image quality and stabilization of image quality are increasing like never before.

For the improvement of image quality, toners have been made smaller in average particle diameter, and particles of the toners have been made rounder in shape with their angular parts removed.

Generally, in an image forming apparatus which operates in accordance with any such electrophotographic image forming method, regardless of which developing method is employed, a drum-shaped or belt-shaped image bearing member (typified by a photoconductor) is uniformly charged while being rotated, a latent image pattern is formed on the image bearing member by laser light or the like, and the latent image pattern is visualized as a toner image by a developing unit and transferred onto a transfer medium.

After the toner image has been transferred onto the transfer medium, untransferred toner components remain on the image bearing member. If such residues are directly conveyed to a region for the charging step, it often hinders the image bearing member from being uniformly charged; accordingly, in general, the toner components, etc. remaining on the image bearing member are removed by a cleaning unit in a cleaning step after the transfer step, thereby bringing the surface of the image bearing member into a clean enough state, and then charging is carried out.

Thus, the image bearing member surface is exposed to various types of physical stress and electrical stress in each steps of charging, developing, transferring and cleaning, and the like, and a state of the image bearing member surface changes over time.

Of these stresses, it is known that the stress caused by friction in the cleaning step wears the image bearing member, and generates scratches. In attempts to solve this problem, a number of proposals for lubricants and methods of supplying lubricant components and forming films have been made thus far to reduce frictional force between the image bearing member and cleaning member.

For example, Japanese Patent Application Publication (JP-B) No. 51-22380 proposes a method of forming a lubricant film on a photoconductor surface by supplying the photoconductor surface with a solid lubricant composed mainly of zinc stearate in order to lengthen the lifetimes of a photoconductor and a cleaning blade.

JP-A No. 2005-274737 discloses that a lubricant supply device for supplying a lubricant mainly containing a higher alcohol having 20 to 70 carbon atoms is used, so that the higher alcohol remains in a form of irregular shaped particles on an edge of a blade nip portion, and has suitable wettability to an image bearing member surface, thereby exhibiting continuously lubricating performance.

JP-A No. 2002-97483 discloses that a powder of a certain alkylene-bis-alkyl acid amide compound as a lubrication component is used so as to provide the powder fine particles at the interface where an image bearing member and a cleaning blade are in contact with each other, thereby maintaining smooth lubrication effect on the surface thereof for a long period.

JP-A No. 2005-171107 discloses that various lubricants obtained by adding an inorganic lubricant to a solid lubricant containing zinc stearate as a main component are supplied to a photoconductor (image bearing member) surface, so as to decrease a frictional force between the image bearing member and a cleaning member.

JP-A No. 2006-350240 discloses that various lubricants obtained by adding boron nitride to a solid lubricant containing zinc stearate as a main component are supplied to a photoconductor (image bearing member) surface, so that lubricity is not easily decreased even when the image bearing member surface is subjected to electrical stress in a charging step, and the lubricant is formed into a film all over the image bearing member surface, thereby maintaining high lubricity.

On the other hand, nowadays, a toner produced by a polymerization method is commercially available in order to enhance image quality and reduce production energy. The polymerized toner has excellent characteristics, for example, it has less angular shape and a small and uniform average particle diameter, compared to a toner produced by a pulverization method. However, in a system in which an edge portion of a cleaning member such as a rubber cleaning blade is pressed to be in contact with an image bearing member surface so as to clean the image bearing member surface, the toner is hard to be blocked at the edge portion, and cleaning failure of the residual toner component easily occurs, due to the shape and particle diameter of the toner.

Some techniques dealing with such toner cleaning failure have been proposed.

For example, according to the technique disclosed in JP-A No. 2007-286594, the use of a hydrophobic and amphipathic organic component allows to remarkably improve cleanability of a toner. Thus, a toner of recent years, which has a small particle diameter and high sphericity, can be cleaned. Moreover, smearing on a charging member is decreased due to improvement in cleanability, and the charging member achieves a longer operating life. Furthermore, since the toner does not pass through a blade, the blade is less worn, and the cleaning blade also achieves a longer operating life.

However, stress on the image bearing member is caused not only in the cleaning step, as described above. Particularly, an electrical stress in the charging step significantly changes a state of a surface of the image bearing member. Moreover, the electrical stress outstandingly occurs in a contact charging system or a close contact charging system, in which a discharging phenomenon occurs near the surface of the image bearing member. In these charging systems, many active species and reaction products are generated on the surface of the image bearing member, and a large amount of the active species and reaction products generated in an atmosphere of a discharge region are adsorbed on the surface of the image bearing member.

A lubricant using zinc stearate, for example, similar to the conventional technique disclosed in JP-B No. 51-22380, relatively uniformly covers the surface of the image bearing member to provide excellent lubricity and protective properties. Thus, zinc stearate is used to prevent the photoconductor wear which is a problem caused in an image forming process, in which AC voltage is applied to charge the image bearing member.

However, zinc stearate has a problem in cleanability. In a normal image forming process, a blade cleaning system is used to remove a residual toner on a photoconductor, from which a toner image has been transferred. However, zinc stearate has properties to make toner more likely to pass through the blade. When the toner passes through the cleaning blade, the toner is directly printed as an image, and smearing on the charging member is further increased. The more significantly the toner passing-through the blade is exhibited, the more spherical and the smaller particle diameter the toner has. Meanwhile, since the lubricant using zinc stearate causes a large amount of the toner passing through the blade, the cleaning blade is worn, shortening the operation life of an image forming apparatus.

In the cleaning step, a large amount of zinc stearate as well as the toner pass through the blade, causing smearing on the charging member. Particularly, in a system in which a charging roller is in contact with or closely adjacent to a photoconductor so as to charge the photoconductor, the smearing on the charging member is increased. When the charging member is smeared, an abnormal image having uneven density is formed due to uneven charge.

In the conventional technique as described in JP-A No. 2005-274737, the lubricant containing higher alcohol easily makes an image bearing member surface wet, and it is expected to exhibit an effect as the lubricant. However, an adsorption area per molecule of the higher alcohol molecule adsorbed on the image bearing member is likely to be broad, and a density of a molecule adsorbed on the image bearing member per unit area (a weight of an adsorbed molecule per unit area of the image bearing member) is small. Thus, the electrical stress easily goes through the protective layer, and it is hard to achieve an effect for sufficiently protecting the image bearing member by using the lubricant.

According to the conventional technique described in JP-A No. 2002-97483, in the case where the lubricant contains a nitrogen atom in a molecule, when the lubricant itself is exposed to the above-mentioned electrical stress, the lubricant in a molecule produces an ionic dissociating compound as a decomposed product like a nitrogen oxide and an ammonium-containing compound, and the ionic dissociating compound is taken into the lubricant layer. Then, the resistance of the lubricant layer is decreased at high humidity, and image blur may occur.

JP-A No. 2005-171107 discloses that fine particles, such as of silica, titania, alumina, magnesia, zirconia, ferrite, and magnetite, are added in a solid lubricant containing zinc stearate as a main component used on a photoconductor surface. However, the toner passing through the blade is not significantly improved by using these inorganic fine particles, and the smearing on the charging roller is not decreased. As a result, an entire image forming apparatus has a short operation life. Moreover, inorganic fine particles leave scratches or scars on the image bearing member, which may cause formation of an abnormal image.

The lubricant disclosed in JP-A No. 2006-350240 has protective properties from the charging member, and remarkably prevents toner from passing through the blade, thereby preventing the charging member from smearing. However, the protecting agent deposits on the image bearing member, causing filming thereon.

The protecting agent disclosed in JP-A No. 2007-286594 does not have sufficient protective properties from charging, causing severe abrasion of the photoconductor. In this case the abrasion speed of the photoconductor becomes 10 times or more faster than that when the zinc stearate is used as described in JP-B No. 51-22380. The abrasion can be decreased to some extend by increasing the amount of the protecting agent coated onto the photoconductor. However, it is impossible to prevent the abrasion completely. Moreover, it is understood that in the case where the amount of the protecting agent is increased, the lubricant is adhered on the photoconductor, causing formation of an abnormal image.

BRIEF SUMMARY OF THE INVENTION

The present invention solves the above conventional problems and attains the following objects.

An object of the present invention is to provide an image-bearing member protecting agent which can achieve a sufficient protecting effect on a surface of an image baring member, prevention of filming on the image bearing member, and prevention of smearing on a charging member.

Another object of the present invention is to provide a protective layer forming device which can form an excellent protective layer for an image bearing member using the image-bearing member protecting agent.

Another object of the present invention is to provide an image forming method and an image forming apparatus, which can achieve a sufficient protecting effect on the surface of the image baring member, prevention of filming on the image bearing member, and prevention of smearing on the charging member by using the image-bearing member protecting agent.

Another object of the present invention is to provide an image forming apparatus, which can obtain high quality images in a stable manner for a long period of time.

Another object of the present invention is to provide a process cartridge, which can obtain a high quality image in a stable manner, and an image forming apparatus provided with the process cartridge.

Means for solving problems is as follows:

<1> An image-bearing member protecting agent including a hydrophobic organic compound (A), an inorganic lubricant (B) and inorganic fine particles (C), wherein each of the inorganic fine particles (C) has a specific surface area of 2.0 $m^2/g$ to 6.5 $m^2/g$.

<2> The image-bearing member protecting agent according to <1>, wherein the hydrophobic organic compound (A) is a material having a lamella crystal.

<3> The image-bearing member protecting agent according to any one of <1> to <2>, wherein the hydrophobic organic compound (A) is a metal salt of fatty acid.

<4> The image-bearing member protecting agent according to any one of <1> to <3>, wherein the inorganic lubricant (B) forms a two dimensional layer structure.

<5> The image-bearing member protecting agent according to any one of <1> to <4>, wherein the inorganic lubricant (B) contains at least one selected from the group consisting of talc, mica, boron nitride, kaolin, plate-shaped alumina, sericite, molybdenum disulfide, tungsten disulfide, montmorillonite, calcium fluoride and graphite.

<6> The image-bearing member protecting agent according to any one of <1> to <5>, wherein the inorganic fine particles (C) are at least one selected from the group consisting of silica, alumina, titanium oxide, zirconium oxide, magnesium oxide, ferrite, and magnetite.

<7> The image-bearing member protecting agent according to any one of <1> to <6>, wherein the image-bearing member protecting agent is a solid formed by compression molding.

<8> A protective layer forming device including a unit configured to apply the image-bearing member protecting agent according to any one of <1> to <7> onto a surface of an image bearing member so as to form a protective layer.

<9> The protective layer forming device according to <8> including a supply member configured to supply the surface of the image bearing member with the image-bearing member protecting agent.

<10> The protective layer forming device according to any one of <8> to <9>, including a layer forming member configured to press the image-bearing member protecting agent which has been supplied to the surface of the image bearing member so as to form the image-bearing member protecting agent into a film.

<11> An image forming method including: forming a latent electrostatic image on an image bearing member; developing the latent electrostatic image using a toner so as to form a visible image; transferring the visible image formed on the image bearing member to a transfer medium; and applying the image-bearing member protecting agent according to any one of <1> to <7> onto a surface of the image bearing member, from which surface the visible image has been transferred to the transfer medium, so as to form a protective layer thereon.

<12> The image forming method according to <11>, wherein the applying the image-bearing member protecting agent is performed by the protective layer forming device according to any one of <8> to <10>.

<13> An image forming apparatus including: an image bearing member; a latent electrostatic image forming unit configured to form a latent electrostatic image on the image bearing member; a developing unit configured to develop the latent electrostatic image using a toner so as to form a visible image; a transfer unit configured to transfer the visible image formed on the image bearing member to a transfer medium; and a protective layer forming device configured to apply the image-bearing member protecting agent according to any one of <1> to <7> onto a surface of the image bearing member, from which the visible image has been transferred to the transfer medium, so as to form a protective layer thereon.

<14> The image forming apparatus according to <13>, wherein the protective layer forming device is the protective layer forming device according to any one of <8> to <10>.

<15> The image forming apparatus according to any one of <13> to <14>, further including a cleaning unit located in a downstream from the transfer unit and an upstream from the protective layer forming device, with respect to the movement direction of the surface of the image bearing member, and configured to be rubbed against the surface of the image bearing member so as to remove the toner remaining thereon.

<16> The image forming apparatus according to any one of <13> to <15>, wherein the image bearing member contains a thermosetting resin at least in the outermost surface layer thereof.

<17> The image forming apparatus according to any one of <13> to <16>, wherein the image bearing member is a photoconductor.

<18> The image forming apparatus according to any one of <13> to <17>, further including a charging unit located in contact with or close to the surface of the image bearing member.

<19> The image forming apparatus according to any one of <13> to <18>, wherein the charging unit includes a voltage applying unit configured to apply a voltage which includes an AC component.

<20> The image forming apparatus according to any one of <13> to <19>, wherein the toner has a circularity SR, represented by Equation 1, in the range of 0.93 to 1.00:

$$\text{Circularity } SR = \text{Circumferential length of a circle having the same area as projected particle area} / \text{Circumferential length of projected particle image} \quad \text{Equation 1.}$$

<21> The image forming apparatus according to any one of <13> to <20>, wherein a ratio (D4/D1) of the mass average particle diameter D4 of the toner to a number average particle diameter D1 of the toner is in the range of 1.00 to 1.40.

<22> A process cartridge integrally including: an image bearing member; and a protective layer forming device configured to apply the image-bearing member protecting agent according to any one of <1> to <7> onto a surface of the image bearing member.

<23> The process cartridge according to <22>, wherein the protective layer forming device is the protective layer forming device according to any one of <8> to <10>.

<24> The process cartridge according to any one of <22> to <23>, further including a cleaning unit located in an upstream from the protective layer forming device, with respect to a movement direction of the surface of the image bearing member, and configured to be rubbed against the surface of the image bearing member so as to remove a toner remaining thereon.

<25> The process cartridge according to any one of <22> to <24>, wherein the image bearing member contains a thermosetting resin at least in the outermost surface layer thereof.

<26> The process cartridge according to any one of <22> to <25>, further including a charging unit located in contact with or close to the surface of the image bearing member.

<27> The process cartridge according to any one of <22> to

<26>, further including a toner container, which contains a toner having a circularity SR, represented by Equation 1, in the range of 0.93 to 1.00:

Circularity $SR$=Circumferential length of a circle having the same area as projected particle area/Circumferential length of projected particle image Equation 1.

<28> The process cartridge according to any one of <22> to <27>, wherein a ratio (D4/D1) of the mass average particle diameter D4 of the toner to a number average particle diameter D1 of the toner is in the range of 1.00 to 1.40.

<29> An image forming apparatus including the process cartridge according to any one of <22> to <28>.

According to the invention, the above-described conventional problems can be solved and attains the object of the present invention. The present invention can provide an image-bearing member protecting agent which can achieve a sufficient protecting effect on a surface of an image baring member, prevention of filming on the image bearing member, and prevention of smearing on a charging member, and can provide a protective layer forming device which can form an excellent protective layer for an image bearing member using the image-bearing member protecting agent.

Moreover, the present invention can provide an image forming method and an image forming apparatus, which can achieve a sufficient protecting effect on the surface of the image baring member, prevention of filming on the image bearing member, and prevention of smearing on the charging member by using the image-bearing member protecting agent or the protective layer forming device, and can provide an image forming apparatus and a process cartridge, which can obtain high quality images in a stable manner for a long period of time.

DETAILED DESCRIPTION OF THE INVENTION

Figure 1:
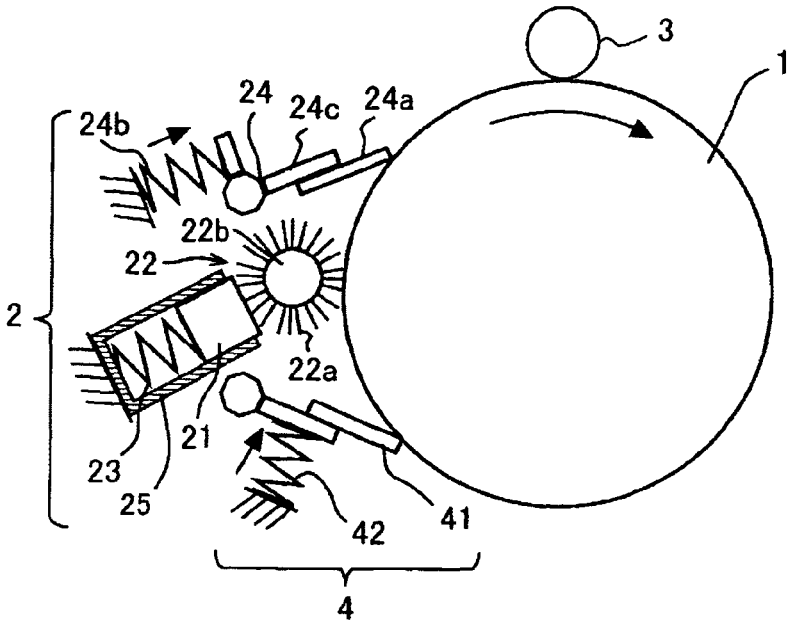
FIG. 1 is a schematic configuration diagram of a main part showing an example of a configuration of a main part of an image forming section provided with a protective layer forming device of the present invention.

Hereinafter, an embodiment of the present invention will be described.

An image forming apparatus of the present invention includes at least an image bearing member, a latent electrostatic image forming unit, a developing unit, a transfer unit, a protective layer forming device.

An image forming method of the present invention includes at least a latent electrostatic image forming step, a developing step, a transferring step, a protective layer forming step.

An image-bearing member protecting agent of the present invention includes at least a hydrophobic organic compound (A), an inorganic lubricant (B), and inorganic fine particles (C), wherein each of the inorganic fine particles (C) has a specific surface area of 2.0 $m^2/g$ to 6.5 $m^2/g$.

(Image-Bearing Member Protecting Agent)

The image-bearing member protecting agent of the present invention includes at least the hydrophobic organic compound (A), the inorganic lubricant (B), and the inorganic fine particles (C) each having a specific surface area of 2.0 $m^2/g$ to 6.5 $m^2/g$, and further includes other components as necessary.

<Hydrophobic Organic Compound (A)>

Example of the hydrophobic organic compound (A) contained in the image-bearing member protecting agent, include hydrocarbons which are classified into saturated aliphatic hydrocarbons, unsaturated aliphatic hydrocarbons, saturated alicyclic hydrocarbons, unsaturated alicyclic hydrocarbons, aromatic hydrocarbons; fluorine resins and fluorine waxes such as polytetrafluoroethylene (PTFE), polyperfluoroalkylether (PFA), perfluoroethylene-perfluoropropylene copolymer (FEP), polyvinylidenefluoride (PVdF), and ethylene-tetrafluoroethylene copolymer (ETFE); and silicone resins and silicone waxes such as polymethyl silicone, and polymethylphenyl silicone. Example of fatty acid, which can obtain fatty acid metal salt, and stable hydrophobic metal salt, includes caproic acid, caprylic acid, enanthylic acid, pelargonic acid, undecylic acid, lauric acid, tridecoic acid, myristic acid, palmitic acid, margaric acid, stearic acid, nonadecanoic acid, arachidic acid, behenic acid, stearidonic acid, palmitoleic acid, oleic acid, ricinoleic acid, petroselinic acid, vaccenic acid, linoleic acid, linolenic acid, eleostearic acid, licanic acid, parinaric acid, gadoleic acid, arachidonic acid, and cetoleic acid, and mixtures thereof. Examples of the stable metal salt of fatty acid include, but not limited to, barium stearate, lead stearate, iron stearate, nickel stearate, cobalt stearate, copper stearate, strontium stearate, calcium stearate, cadmium stearate, magnesium stearate, zinc stearate, zinc oleate, magnesium oleate, iron oleate, cobalt oleate, copper oleate, lead oleate, manganese oleate, zinc palmitate, cobalt palmitate, lead palmitate, magnesium palmitate, aluminum palmitate, calcium palmitate, lead caprylate, lead caprate, zinc linolenate, cobalt linolenate, calcium linolenate, zinc ricinoleate, cadmium ricinoleate and mixtures thereof. These may be used alone or in combination.

<Inorganic Lubricant (B)>

The inorganic lubricant (B) contained in the image-bearing member protecting agent is an inorganic lubricant, and forms a two dimensional layer structure. Examples thereof include, but not limited to, talc, mica, boron nitride, molybdenum disulfide, tungsten disulfide, kaolin, smectite, hydrotalcite compounds, calcium fluoride, graphite, plate-shaped alumina, sericite and synthetic mica. These may be used alone or in combination.

<Inorganic Fine Particles (C)>

The inorganic fine particles (C) each having a specific surface area of 2.0 $m^2/g$ to 6.5 $m^2/g$ form a two dimensional layer structure, which has a different property from the two dimensional layer structure formed by the inorganic lubricant (B). The inorganic fine particles (C) have no lubricity between the layers. Examples of the inorganic fine particles (C) include, but not limited to, metal oxides such as silica, tin oxide, zinc oxide, titanium oxide, alumina, zirconium oxide, indium oxide, antimony oxide, bismuth oxide, calcium oxide, tin oxide doped with antimony, indium oxide doped with tin; metal fluoride such as tin fluoride, calcium fluoride, aluminum fluoride; and potassium titanate. These may be used alone or in combination.

Each of the inorganic fine particles (C) has a specific surface area of 2.0 $m^2/g$ to 6.5 $m^2/g$, and particularly preferably 3.0 $m^2/g$ to 6.0 $m^2/g$. When the specific surface area of the inorganic fine particles (C) is in the particularly preferable range, it is possible to favorably prevent filming on an image bearing member, occurrence of a scar on the image bearing member, and smearing on a charging member.

(Protective Layer Forming Device)

The protective layer forming device of the present invention is used in an image forming method and apparatus, and configured to apply or attach the image-bearing member protecting agent onto a surface of the image bearing member, so as to form a protective layer, wherein the image-bearing member protecting agent containing the hydrophobic organic compound (A), the inorganic lubricant (B) and the inorganic fine particles (C) is used as a protecting agent for the image-bearing member. Hereinafter, an embodiment of the protective layer forming device of the present invention will be described with reference to drawings.

FIG. 1 is a schematic configuration diagram of a main part showing an example of a configuration of a main part of an image forming section provided with a protective layer forming device of the present invention.

A protective layer forming device 2 is located so as to face an image bearing member (such as a photoconductor drum) 1, and mainly includes an image-bearing member protecting agent 21 which is a protecting agent for the image bearing member 1 and formed into a circular, quadrangular, or hexagonal shape, etc. by compression molding, a protecting agent supply member 22 which has a brush 22*a* which is brought into contact with the image-bearing member protecting agent 21, and supplies the protecting agent via the brush 22*a* to the image bearing member 1, a pressing force applying mechanism 23 which presses the image-bearing member protecting agent 21 against the brush 22*a* of the protecting agent supply member 22 so as to supply the protecting agent to the brush 22*a* of the protecting agent supply member 22, a protective layer forming mechanism 24 for making a thin layer of the protecting agent which is supplied to the image bearing member by the protecting agent supply member 22, and a protecting agent supporting member 25 for supporting the protecting agent 21 so as not to swing. The image-bearing member protecting agent 21 of the present invention includes the hydrophobic organic compound (A), the inorganic lubricant (B), and the inorganic fine particles (C) each having a specific surface area of 2.0 $m^2/g$ to 6.5 $m^2/g$, and further includes other components as necessary. A cleaning mechanism (cleaning unit) 4 is located in the upstream from the protecting agent supply member 22 with respect to the movement direction (rotation direction) of the image bearing member, which is represented by an arrow in FIG. 1. The cleaning mechanism 4 is also considered as a part of the protective layer forming device 2. The locations of the image-bearing member protecting agent 21 and the protecting agent supply member 22 shown in FIG. 1 are only an example, and not limited thereto.

The image-bearing member protecting agent 21 containing the hydrophobic organic compound (A), the inorganic lubricant (B) and the inorganic fine particles (C) may be pressed by the pressing force applying member 23 such as a spring, and brought into contact with the brush-shaped protecting agent supply member 22. The brush 22*a* of the protecting agent supply member 22 rotates at a linear velocity different from that of the image bearing member 1 and rubs the surface of the image bearing member 1, so as to supply the surface of the image bearing member with the image-bearing member protecting agent 21 held on the surface of the protecting agent supply member.

The image-bearing member protecting agent 21 supplied to the surface of the image bearing member may not sufficiently form a protective layer upon supplying, depending on the materials used for the image-bearing member protecting agent 21. In order to form a more uniform protective layer, the protective layer is formed into a thin layer using the protective layer forming mechanism 24 having a blade-shaped member 24*a* serving as a layer forming member, and a pressing member 24*b* such as a spring which presses the blade-shaped member 24*a* onto a surface of the photoconductor drum 1, thereby obtaining the protective layer for the surface of the image bearing member.

The image bearing member 1 on which the protective layer is formed is charged in such a manner that the charging member (for example, a charging roller) 3, on which direct current or direct current superimposed with alternate current applied by a voltage applying unit such as a high-voltage generator (not shown), is in contact with or closely adjacent to the surface of the image bearing member so as to discharge electricity in a minute gap between the charging member 3 and the image bearing member 1. During this process, electrical stress causes decomposition and oxidization in a part of the protective layer, and discharge products in the air may adhere onto the surface of the protective layer, formed into a deteriorated material.

The deteriorated image-bearing member protecting agent is removed together with other components such as toner particles remaining on the surface of the image bearing member by a typical cleaning mechanism. The protective layer forming mechanism 24 may also be served as the cleaning mechanism. However, adequate friction requirement for removing residue remaining on the surface of the image bearing member may not be the same as that for forming the protective layer, thus these functions are preferably separated. As shown in FIG. 1, a cleaning mechanism (cleaning unit) 4 which includes a cleaning member 41 and a cleaning pressing force mechanism 42, is preferably located in the upstream from the image-bearing member protecting agent supply member with respect to the movement direction (rotation direction) of the image bearing member 1.

The material used for the blade shaped member (hereinafter called as a blade) 24*a* used in the protective layer forming mechanism 24 is not particularly limited, and known elastic materials for cleaning blades can be used. Examples thereof include a urethane rubber, hydrin rubber, silicone rubber and fluorine rubber. These may be used alone or in a blended manner. Additionally, a portion of the rubber blade, which comes into contact with the image bearing member 1, may be coated or impregnated with a low friction coefficient material. Further, in order to adjust the hardness of the elastic material used, fillers such as organic fillers or inorganic fillers may be dispersed in the elastic material.

The blade is fixed on a blade support 24*c* by any method such as adhesion or fusion bond so that a tip of the blade can be press contacted with the surface of the image bearing member. The thickness of the blade 24*a* cannot be unequivocally defined because the thickness is decided in view of the force applied upon pressing the blade. The thickness is preferably approximately 0.5 mm to approximately 5 mm, and more preferably approximately 1 mm to approximately 3 mm.

The length of the cleaning blade which protrudes from the blade support 24*c* and may bend, so-called free length, cannot also be unequivocally defined because the length is decided in view of the force applied. The length is preferably approximately 1 mm to approximately 15 mm, and more preferably approximately 2 mm to approximately 10 mm.

Another structure of the blade shaped member for forming the protective layer may be employed in which a layer of a resin, rubber, elastomer, etc. is formed over a surface of an elastic metal blade such as a spring plate, using a coupling agent, a primer component, etc. as necessary, by a method such as coating or dipping, then may be subjected to thermal curing or the like, and further subjected to surface polishing or the like, as necessary.

The thickness of the elastic metal blade is preferably approximately 0.05 mm to approximately 3 mm, and more preferably approximately 0.1 mm to approximately 1 mm.

In order to prevent the elastic metal blade from being twisted, the blade may be bent in a direction substantially parallel to a support shaft after the installation of the blade.

As the material for forming a surface layer of the blade, a fluorine resin such as PFA, PTFE, FEP or PVdF, a fluorine rubber, a silicone elastomer such as methylphenyl silicone elastomer, or the like may be used with the addition of a filler, as necessary. However, the material is not limited thereto.

The force with which the image bearing member 1 is pressed by the protective layer forming mechanism 24 is sufficient as long as it allows the image-bearing member protecting agent to spread to be formed into a protective layer or a protective film. The force is preferably in the range of 5 gf/cm to 80 gf/cm, and more preferably in the range of 10 gf/cm to 60 gf/cm, as a linear pressure.

A brush-shaped member 22*a* is preferably used as the protecting agent supply member 22; in this case, brush fibers of the brush-shaped member preferably have flexibility to reduce mechanical stress on the surface of the image bearing member.

As the material for the flexible brush fibers, one or more resins having flexibility among those known in the art may be generally used. Examples thereof include polyolefin resins such as polyethylene and polypropylene; polyvinyl resins and polyvinylidene resins such as polystyrene, acrylic resins, polyacrylonitrile, polyvinyl acetate, polyvinyl alcohol, polyvinyl butyral, polyvinyl chloride, polyvinyl carbazole, polyvinyl ethers and polyvinyl ketones; vinyl chloride-vinyl acetate copolymers; styrene-acrylic acid copolymers; styrene-butadiene resins; fluorine resins such as polytetrafluoroethylene, polyvinyl fluoride, polyvinylidene fluoride and polychlorotrifluoroethylene; polyesters; nylons; acrylics; rayons; polyurethanes; polycarbonates; phenol resins; and amino resins such as urea-formaldehyde resins, melamine resins, benzoguanamine resins, urea resins and polyamide resins. These may be used alone or in combination.

To adjust the extent to which the brush bends, diene rubber, styrene-butadiene rubber (SBR), ethylene propylene rubber, isoprene rubber, nitrile rubber, urethane rubber, silicone rubber, hydrin rubber, norbornene rubber and the like may be used in combination.

A support 22*b* of the brush 22*a* of the protecting agent supply member 22 may be a stationary support or a roll-shaped rotatable support. The protecting agent supply member 22 having the roll-shaped support is exemplified by a roll brush formed by spirally winding a tape made of a pile fabric formed of brush fibers around a metal core. Each brush fiber preferably has a diameter of approximately 10 μm to approximately 500 μm and a length of 1 mm to 15 mm, and a density, in which the number of the brush fibers is preferably $1.0\times10^4$ per square inch to $3.0\times10^5$ per square inch ($1.5\times10^7$ per square meter to $4.5\times10^8$ per square meter).

For the protecting agent supply member 22, use of a material having a high brush fiber density is highly desirable in terms of uniformity and stability of the supply. It is preferred that one fiber be formed from several to several hundreds of fine fibers. Specifically, 50 fine fibers of 6.7 decitex (6 denier) may be bundled together and planted as one fiber, as exemplified by the case of 333 decitex=6.7 decitex×50 filaments (300 denier=6 denier×50 filaments).

Additionally, if necessary, the brush surface may be provided with a coating layer for the purpose of stabilizing the shape of the brush surface, the environment stability, and the like. As a component of the coating layer, the component capable of deforming in conformity to the bending of the brush fibers is preferably used, and the component is not limited in any way as long as it can maintain its flexibility. Examples of the component include polyolefin resins such as polyethylene, polypropylene, chlorinated polyethylene and chlorosulfonated polyethylene; polyvinyl resins and polyvinylidene resins, such as polystyrene, acrylics (e.g. polymethyl methacrylate), polyacrylonitrile, polyvinyl acetate, polyvinyl alcohol, polyvinyl butyral, polyvinyl chloride, polyvinyl carbazole, polyvinyl ethers and polyvinyl ketones; vinyl chloride-vinyl acetate copolymers; silicone resins including organosiloxane bonds, and modified products thereof (e.g. modified products made of alkyd resins, polyester resins, epoxy resins, polyurethanes, etc.); fluorine resins such as perfluoroalkyl ethers, polyfluorovinyl, polyfluorovinylidene and polychlorotrifluoroethylene; polyamides; polyesters; polyurethanes; polycarbonates; amino resins such as urea-formaldehyde resins; epoxy resins; and combinations of these resins.

(Process Cartridge)

An embodiment of a process cartridge of the present invention will be described.

A process cartridge of the present invention includes at least the image bearing member and the protective layer forming device configured to apply or adhere the image-bearing member protecting agent onto a surface of the image bearing member so as to form a protective layer thereon, and further includes other units such as the charging unit, an exposing unit, the developing unit, the transfer unit, the cleaning unit, a charge eliminating unit, as necessary.

As the protective layer forming unit, the protective layer forming device of the present invention may be preferably used.

The process cartridge of the present invention can be detachably provided in various electrophotographic apparatuses, and it is preferred that the process cartridge be detachably attached to the image forming apparatus of the present invention which will be described below.

Figure 2:
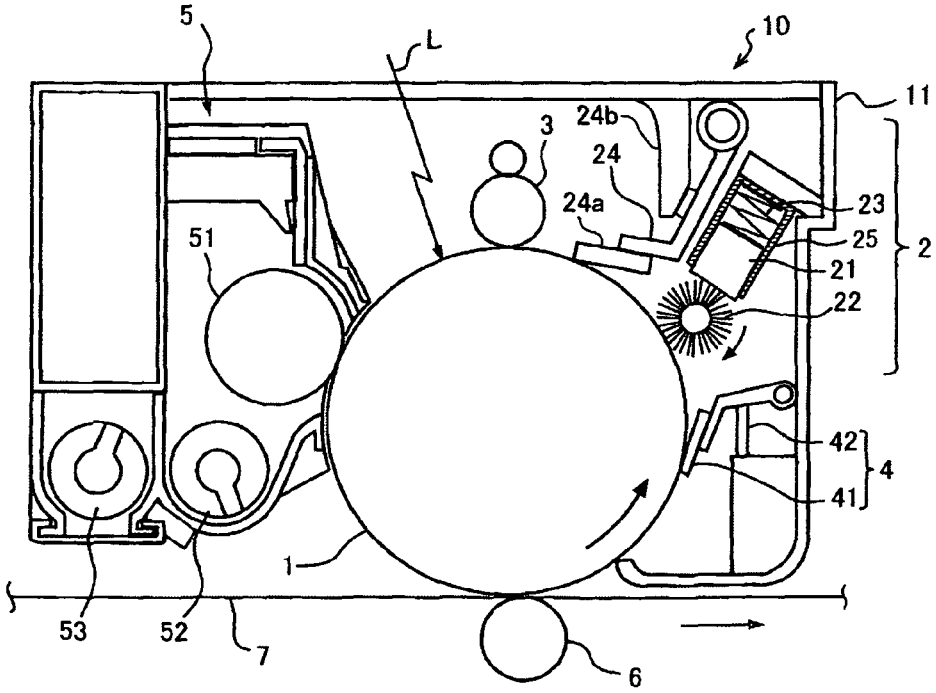
FIG. 2 is a schematic cross sectional diagram schematically showing a configuration example of a process cartridge using a protective layer forming device of the present invention.

FIG. 2 is a schematic cross sectional view schematically showing a configuration example of a process cartridge using the protective layer forming device of the present invention. The process cartridge is detachably provided in an image forming section 10 of the image forming apparatus of the present invention.

The image forming section 10 shown in FIG. 2 includes an image bearing member (for example, photoconductor drum) 1, a charging unit (charging roller in FIG. 2) 3 for charging the image bearing member 1, a latent electrostatic image forming unit (not shown) for irradiating the charged image bearing member 1 with a laser light L or the like so as to form a latent electrostatic image, a developing unit 5 for developing the latent electrostatic image on the image bearing member 1 using a toner so as to form a visible image (toner image), a transfer unit 6 for transferring the visible image on the image bearing member 1 onto a transfer medium (recording medium such as paper, or an intermediate transfer medium) 7, a cleaning unit 4 for removing a residual toner on a surface of the image bearing member 1, from which the visible image has been transferred, and a protective layer forming device 2 provided between the cleaning unit 4 and the charging unit 3. The image forming section 10 is constituted with a process cartridge 11, which integrally includes the image bearing member 1, the protective layer forming device 2, the charging unit 3, the developing unit 5, and the cleaning unit 4 in a cartridge. In this embodiment, the cleaning unit 4 is configured to clean the surface of the photoconductor before the surface of the photoconductor is supplied with the protecting agent, so as to be suitably coated with the protecting agent. Thus, the cleaning unit 4 is located in the downstream from the transfer unit 6 and the upstream from the protective layer forming device 2, with respect to a movement direction (rotation direction) of the image bearing member 1, and the cleaning unit 4 is also considered as a part of the protective layer forming device 2.

In the process cartridge 11, the protective layer forming device 2 located so as to face a photoconductor drum, which is the image bearing member 1, consists of an image-bearing member protecting agent 21, a protecting agent supply member 22, a pressing force applying mechanism 23, a protective layer forming mechanism 24, a protecting agent supporting member 25, and the like.

On the surface of the image bearing member 1 after image formation, the image-bearing member protecting agent which has been partly deteriorated after the transfer step, toner components and the like remain. The residue on the surface is cleaned using a cleaning member 41 of the cleaning unit 4.

In FIG. 2, the cleaning member 41 is in contact with the image bearing member 1 at an angle similar to a so-called counter type (leading type). Meanwhile, the blade 24*a* of the protective layer forming mechanism 24 shown in FIG. 2 is not in contact with the image bearing member 1 in the counter type, but this blade 24*a* may also be contacted with the image bearing member 1 at an angle similar to a so-called counter type.

To the surface of the image bearing member, from which the residual toner and deteriorated image-bearing member protecting agent are removed by a cleaning unit 4, the image-bearing member protecting agent 21 is supplied via the protecting agent supply member 22 of the protective layer forming device 2, thereby forming a protective layer in a form of a film using the protective layer forming mechanism 24. In this case, the image-bearing member protecting agent 21 of the present invention can supply necessary amount to the surface of the image bearing member in a stable manner with good controllability, so as to effectively protect the surface of the image bearing member, thereby protecting the degradation of the image bearing member itself for a long period of time.

The surface of the image bearing member 1, on which the protective layer has been formed, is charged by the charging unit (charging roller) 3, and then exposed by a laser L so as to form a latent electrostatic image thereon, and then the latent electrostatic image is developed and formed into a visible image using the developing unit 5, and then transferred onto the transfer medium (a recording medium such as paper, or an intermediate transfer medium) 7 by the transfer unit (transfer roller) 6 which is located outside of the process cartridge.

As described above, the process cartridge 11 of the present invention is so configured as to have wide acceptable ranges with respect to the variation in the state of the image bearing member surface, and to highly reduce the variation in charging performance to the image bearing member. Therefore, by the use of the process cartridge 11 in the image forming section of the image forming apparatus, images of significantly high quality are formed in a stable manner for a long period of time.

(Image Forming Apparatus and Image Forming Method)

The image forming apparatus of the present invention includes at least the image bearing member, the latent electrostatic image forming unit, the developing unit, the transfer unit and the protective layer forming unit (the protective layer forming device of the present invention), and preferably includes a fixing unit and the cleaning unit, and further includes other units suitably selected as necessary, for example, the charge eliminating unit, a recycling unit, a controlling unit, etc.

The image forming method of the present invention includes at least the latent electrostatic image forming step, the developing step, the transferring step, and the protective layer forming step, and preferably includes a fixing step and a cleaning step, and further includes other steps suitably selected as necessary, for example, a charge eliminating step, a recycling step, a controlling step, etc.

The image forming method of the present invention is preferably performed by the image forming apparatus of the present invention, the latent electrostatic image forming step is performed by the latent electrostatic image forming unit, the developing step is performed by the developing unit, the transferring step is performed by the transfer unit, the protective layer forming step is performed by the protective layer forming unit (the protective layer forming device of the present invention), the fixing step is performed by the fixing unit, and other steps are performed by other units.

<Latent Electrostatic Image Forming Step and Latent Electrostatic Image Forming Unit>

The latent electrostatic image forming step is a step of forming a latent electrostatic image on an image bearing member.

—Image Bearing Member—

The material, shape, structure, size, and the like of the image bearing member (otherwise, referred to as "latent electrostatic image bearing member" or "photoconductor") are not particularly limited and may be appropriately selected from those known in the art. As to the shape, a drum-shape is preferred. As to the material, for example, inorganic photoconductors such as amorphous silicon, and selenium; and organic photoconductors such as polysilane, and phthalopolymethine are preferably exemplified.

The image bearing member (photoconductor) used in the image forming apparatus of the present invention includes a conductive substrate and a photosensitive layer provided on the conductive substrate, and further include other layers, as necessary.

The structure of the photosensitive layer is selected from a single-layer structure in which a charge generating material and a charge transporting material are present in a mixed manner, a regular layer structure in which a charge transporting layer is provided on a charge generating layer, and an opposite layer structure in which a charge generating layer is provided on the charge transporting layer. Additionally, the outermost surface layer may be provided on the photosensitive layer in order to improve the mechanical strength, abrasion resistance, gas resistance, cleanability, etc. of the photoconductor. Further, an underlying layer may be provided between the photosensitive layer and the conductive substrate. Also, if necessary, an appropriate amount of a plasticizer, an antioxidant, a leveling agent, etc. may be added to each layer.

—Conductive Substrate—

As the conductive substrate, it is not particularly limited as long as a material exhibiting conductivity of $1.0\times10^{10}$ Ω·cm or less in volume resistance is used and may be appropriately selected depending on the intended purpose. Examples of the conductive substrate include those formed by coating a film-like or cylindrical piece of plastic or paper with the material having a conductivity of $1.0\times10^{10}$ Ω·cm or less in volume resistance, specifically a metal such as aluminum, nickel, chrome, nichrome, copper, gold, silver or platinum or a metal oxide such as tin oxide or indium oxide by means of vapor deposition or sputtering; a plate of aluminum, aluminum alloy, nickel, stainless, etc.; and a tube produced by forming the plate into a drum-shaped tube by means of drawing, extrusion, etc. and then surface-treating the tube by means of cutting, superfinishing, polishing, etc.

A drum-shaped conductive substrate preferably has a diameter of 20 mm to 150 mm, preferably 24 mm to 100 mm, and more preferably 28 mm to 70 mm. When the drum-shaped conductive substrate has a diameter of less than 20 mm, it is physically difficult to dispose, around the drum, a plurality of devices and units for charging, exposing, developing, transferring and cleaning. When the drum-shaped conductive substrate has a diameter of greater than 150 mm, it is undesirable because the size of the image forming apparatus is enlarged. Particularly, in the case where the image forming apparatus is of tandem type, it is necessary to mount a plurality of photoconductor drums therein. Thus, the diameter of the conductive substrate is preferably 70 mm or less, and more preferably 60 mm or less. The endless nickel belt and the endless stainless steel belt disclosed in JP-A No. 52-36016 may be used as the conductive substrate.

—Underlying Layer—

The underlying layer may be formed of a layer or a multiple layers. Examples of the underlying layer of the photoconductor include (1) layer mainly composed of a resin, (2) a layer mainly composed of a white pigment and a resin, and (3) an oxidized metal film obtained by chemically or electrochemically oxidizing the surface of a conductive substrate; preference is given to the layer mainly composed of a white pigment and a resin.

Examples of the white pigment include metal oxides such as titanium oxide, aluminum oxide, zirconium oxide and zinc oxide; of these, it is most preferable to use titanium oxide which is excellent in preventing penetration of electric charge from the conductive substrate.

Examples of the resin used for the underlying layer include thermoplastic resins such as polyamide, polyvinyl alcohol, casein and methyl cellulose, and thermosetting resins such as acrylics, phenol resins, melamine resins, alkyds, unsaturated polyesters and epoxies. These may be used alone or in combination.

The thickness of the underlying layer is not particularly limited and may be appropriately selected depending on the intended purpose. It is preferably 0.1 μm to 10 μm, more preferably 1 μm to 5 μm.

—Charge Generating Material—

Examples of the charge generating material of the photoconductor layer include azo pigments such as monoazo pigments, bisazo pigments, trisazo pigments and tetrakisazo pigments; organic pigments and dyes such as triarylmethane dyes, thiazine dyes, oxazine dyes, xanthene dyes, cyanine pigments, styryl pigments, pyrylium dyes, quinacridone pigments, indigo pigments, perylene pigments, polycyclic quinone pigments, bisbenzimidazole pigments, indanthrone pigments, squarylium pigments and phthalocyanine pigments; and inorganic materials such as selenium, selenium-arsenic, selenium-tellurium, cadmium sulfide, zinc oxide, titanium oxide and amorphous silicon. These may be used alone or in combination.

—Charge Transporting Material—

Examples of the charge transporting material of the photoconductor layer include anthracene derivatives, pyrene derivatives, carbazole derivatives, tetrazole derivatives, metallocene derivatives, phenothiazine derivatives, pyrazoline compounds, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives and triphenylmethane derivatives. These may be used alone or in combination.

—Binder Resin—

Binder resins used for forming the photosensitive layer has electrically insulating properties and may be selected from known thermoplastic resins, thermosetting resins, photocurable resins, photoconductive resins and the like. Suitable examples thereof include, but not limited to, thermoplastic resins such as polyvinyl chloride, polyvinylidene chloride, vinyl chloride-vinyl acetate copolymers, vinyl chloride-vinyl acetate-maleic anhydride copolymers, ethylene-vinyl acetate copolymers, polyvinyl butyral, polyvinyl acetal, polyesters, phenoxy resins, (meth)acrylic resins, polystyrene, polycarbonates, polyarylate, polysulphone, polyethersulphone and ABS resins; thermosetting resins such as phenol resins, epoxy resins, urethane resins, melamine resins, isocyanate resins, alkyd resins, silicone resins and thermosetting acrylic resins; and polyvinylcarbazole, polyvinylanthracene and polyvinylpyrene. These may be used alone or in combination.

—Antioxidant—

Examples of the antioxidant include phenolic compounds, p-phenylenediamines, organic sulfur compounds and organic phosphorus compounds.

Examples of the phenolic compounds include
2,6-di-t-butyl-p-cresol, butylated hydroxyanisole,
2,6-di-t-butyl-4-ethylphenol, stearyl-β-(3,5-di-t-butyl-4-hydroxyphenyl)propionate,
2,2'-methylene-bis-(4-methyl-6-t-butylphenol),
2,2'-methylene-bis-(4-ethyl-6-t-butylphenol),
4,4'-thiobis-(3-methyl-6-t-butylphenol),
4,4'-butylidenebis-(3-methyl-6-t-butylphenol),
1,1,3-tris-(2-methyl-4-hydroxy-5-t-butylphenyl)butane,
1,3,5-trimethyl-2,4,6-tris(3,5-di-t-butyl-4-hydroxybenzyl) benzene,
tetrakis-[methylene-3-(3',5'-di-t-butyl-4'-hydroxyphenynl) propionate]
methane, bis[3,3'-bis(4'-hydroxy-3'-t-butylphenyl)butylic acid]glycol ester,
and tocophenols.

Examples of the p-phenylenediamines include
N-phenyl-N' isopropyl-p-phenylenediamine,
N,N'-di-sec-butyl-p-phenylenediamine,
N-phenyl-N-sec-butyl-p-phenylenediamine,
N,N'-di-isopropyl-p-phenylenediamine, and
N,N'-dimethyl-N,N'-di-t-butyl-p-phenylenediamine.

Examples of the hydroquinones include 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Examples of the organic sulfur compounds include dilauryl-3,3'-thiodipropionate, distearyl-3,3'-thiodipropionate, and ditetradecyl-3,3'-thiodipropionate.

Examples of the organic phosphorus compounds include triphenylphosphine, tri(nonylphenyl)phosphine, tri(dinonylphenyl)phosphine, tricresylphosphine, and tri(2,4-dibutylphenoxy)phosphine.

These compounds are known as the antioxidants for rubbers, plastics and oils, and commercially available products thereof can be easily obtained.

The amount of the antioxidant is preferably 0.01% by mass to 10% by mass relative to the total mass of the layer to be added.

—Plasticizer—

As the plasticizer, a resin such as dibutyl phthalate or dioctyl phthalate generally used as a plasticizer can be used without change. It is appropriate that the amount of the plasticizer used be 0 parts by mass to 30 parts by mass relative to 100 parts by mass of the binder resin.

A leveling agent may be added into the photosensitive layer. Examples of the leveling agent include silicone oils such as dimethyl silicone oil and methylphenyl silicone oil; and polymers or oligomers having perfluoroalkyl groups in their side chains. The amount of the leveling agent used is preferably 0 parts by mass to 1 part by mass relative to 100 parts by mass of the binder resin.

The formation of the latent electrostatic image is achieved by, for example, exposing the image bearing member imagewise after uniformly charging its entire surface. This step is performed by means of the latent electrostatic image forming unit. The latent electrostatic image forming unit includes at least the charging unit (the charging unit 3) configured to uniformly charge the surface of the image bearing member, and the exposing unit (the exposing unit such as laser light) configured to expose imagewise the surface of the image bearing member.

The charging step is achieved by, for example, applying voltage to the surface of the image bearing member 1 by means of the charging unit 3.

The charging unit is not particularly limited and may be appropriately selected depending on the intended purpose. Examples thereof include known contact-chargers equipped with a conductive or semiconductive roller, blush, film or rubber blade, and known non-contact-chargers utilizing corona discharge such as corotron or scorotoron.

The charging unit preferably has a voltage applying unit configured to apply voltage which includes AC component.

The exposing step is achieved by, for example, exposing the surface of the image bearing member imagewise by means of the exposing unit.

The exposing unit is not particularly limited as long as it is capable of performing imagewise exposure on the charged surface of the image bearing member 1 by means of the charging unit 3, and may be appropriately selected depending on the intended purpose. Examples thereof include various exposing units, such as a copy optical system, a rod-lens-array system, a laser optical system, a liquid crystal shatter optical system, and an LED array optical system.

Note in the present invention that a backlight system may be employed, where imagewise exposure is performed from the back side of the image bearing member.

<Developing Step and Developing Unit>

The developing step is a step of developing a latent electrostatic image using a toner or a developer to form a visible image.

A visible image may be formed by, for example, developing a latent electrostatic image with the use of a toner or a developer, and may be performed by the developing unit.

The developing unit is not particularly limited as long as an image can be developed with the use of a toner or a developer, and may be appropriately selected from those known in the art. For example, preferred is the developing unit housing the toner or developer, and capable of applying the toner or the developer to the latent electrostatic image in a contact or non-contact manner.

—Toner—

Next, a toner suitably used in the present invention will be explained.

The toner preferably has an average circularity of 0.93 to 1.00, and more preferably 0.95 to 0.99. The circularity is an average value of circularity SR represented by Equation 1, and indicates the degree of unevenness of a toner particle; when the toner particle is perfectly spherical, the circularity is 1.00; meanwhile, the more complex the surface shape of the toner particle becomes, the smaller the circularity becomes.

$$\text{Circularity SR} = \frac{\text{Circumferential length of a circle having the same area as projected particle area}}{\text{Circumferential length of projected particle image}} \quad \text{Equation 1}$$

When the average circularity is in the range of 0.93 to 1.00, the surface of toner particles is smooth, and the area where the toner particles are in contact with one another and the area where the toner particles are in contact with the photoconductor drum surface are small, so that excellent transferability can be obtained. The toner particles do not have angles, so that the torque with which a developer is stirred in a developing unit can be reduced and the driving for stirring can be stabilized; therefore, abnormal images are not formed. Since the toner particles which form dots do not include angular toner particles, pressure is uniformly applied to the entire toner particles when they are transferred and pressed onto a recording medium, and thus absence of toner particles hardly occurs during the transfer. Since the toner particles are not angular, the toner particles themselves have little abrasive power, thus not damaging or abrading the surface of the image bearing member.

Next, a method of measuring the circularity will be explained.

The circularity SR can be measured using the flow-type particle image analyzer FPIA-1000 (produced by To a Medical Electronics Co., Ltd.).

Specifically, 0.1 mL to 0.5 mL of a surfactant (preferably alkylbenzene sulfonate) is added as a dispersant into 100 mL to 150 mL of water in a container, from which solid impurities have previously been removed. Then, approximately 0.1 g to 0.5 g of a measurement sample (toner) is added. The suspension in which the sample is dispersed is subjected to dispersing treatment by an ultrasonic dispersing device for approximately 1 min to 3 min, and the concentration of the dispersed solution is adjusted such that the number of particles of the sample is 3,000 per microliter to 10,000 per microliter. Under this condition, the particle shape and particle size of the toner are measured using the analyzer.

In the present embodiment, the toner preferably has a mass average particle diameter D4 of 3 μm to 10 μm, and more preferably 4 μm to 8 μm. When the mass average particle diameter D4 is in this range, the toner includes particles which are sufficiently small in diameter with respect to fine dots of a latent image, thereby obtaining superior dot reproducibility. When the mass average particle diameter D4 is less than 3 μm, phenomena of decrease in transfer efficiency and blade cleaning capability easily arise. When the mass average particle diameter D4 is greater than 10 μm, it is difficult to reduce raggedness of lines and letters/characters.

The ratio (D4/D1) of the mass average particle diameter D4 of the toner to a number average particle diameter D1 of the toner is preferably in the range of 1.00 to 1.40, and more preferably 1.00 to 1.30. The closer the value of the ratio (D4/D1) is to 1, the sharper the particle size distribution of the toner is. Thus, when the ratio (D4/D1) is in the range of 1.00 to 1.40, differences in particle diameter of the toner do not cause particles to be unevenly used for image formation, so that the image quality can be excellently stabilized. Since the particle size distribution of the toner is sharp, the distribution of the frictional charge amount is also sharp, and thus the occurrence of fogging can be reduced. When the toner has a uniform particle diameter, a latent image is developed such that particles are accurately and neatly arranged on dots of the latent image, and thus superior dot reproducibility can be obtained.

The mass average particle diameter D4, and particle size distribution of the toner particles are measured by a coulter counter method or the like. Examples of a measuring device for particle size distribution of toner particles by the coulter counter method include COULTER COUNTER TA-II and COULTER MULTISIZER II (both of which are manufactured by Beckman Coulter, Inc.).

Firstly, 0.1 mL to 5 mL of a surfactant (preferably alkylbenzene sulfonate) is added as a dispersant into 100 mL to 150 mL of an electrolytic aqueous solution. Here, the electrolytic aqueous solution is an approximately 1% NaCl aqueous solution prepared using primary sodium chloride. For the preparation, ISOTON-II (manufactured by Beckman Coulter, Inc.) can be used, for example. Then, 2 mg to 20 mg of a measurement sample is added. The electrolytic aqueous solution in which the sample is suspended is subjected to dispersing treatment by an ultrasonic dispersing device for approximately 1 min to 3 min, then the volume of the toner or toner particles and the number of the toner particles are measured by the measuring device, using apertures of 100 μm each, and the volume distribution and the number distribution are thus calculated. The mass average particle diameter D4 and the number average particle diameter D1 of the toner can be calculated from these distributions obtained. As channels, the following 13 channels are used, and particles having diameters which are equal to or greater than 2.00 μm, and less than 40.30 μm are targeted: a channel of 2.00 μm or greater, and less than 2.52 μm; a channel of 2.52 μm or greater, and less than 3.17 μm; a channel of 3.17 μm or greater, and less than 4.00 μm; a channel of 4.00 μm or greater, and less than 5.04 μm; a channel of 5.04 μm or greater, and less than 6.35 μm; a channel of 6.35 μm or greater, and less than 8.00 μm; a channel of 8.00 μm or greater, and less than 10.08 μm; a channel of 10.08 μm or greater, and less than 12.70 μm; a channel of 12.70 μm or greater, and less than 16.00 μm; a channel of 16.00 μm or greater, and less than 20.20 μm; a channel of 20.20 μm or greater, and less than 25.40 μm; a channel of 25.40 μm or greater, and less than 32.00 μm; and a channel of 32.00 μm or greater, and less than 40.30 μm.

As such a substantially spherical toner, it is preferable to use a toner obtained by cross-linking and/or elongating a toner composition including a polyester prepolymer which has a nitrogen atom-containing functional group, a polyester, a colorant and a releasing agent in the presence of fine resin particles in an aqueous medium. The toner produced by the cross-linking and/or elongating reaction can reduce hot offset by hardening the toner surface and thus to suppress smears from being left on a fixing device and appearing on images.

Examples of prepolymers made from modified polyester resins include isocyanate group-containing polyester prepolymers (A). Examples of compounds which elongate and/or cross-link with the prepolymers include amines (B).

Examples of the isocyanate group-containing polyester prepolymers (A) include a compound obtained by reaction between a polyisocyanate (3) and a polyester which is a polycondensate of a polyol (1) and a polycarboxylic acid (2) and contains an active hydrogen group. Examples of the active hydrogen group of the polyester include hydroxyl groups (for example, alcoholic hydroxyl groups and phenolic hydroxyl groups), amino groups, carboxyl groups and mercapto groups, with preference being given to alcoholic hydroxyl groups.

Examples of the polyol (1) include diols (1-1) and trihydric or higher polyols (1-2), and it is preferable to use any of the diols (1-1) alone, or mixtures each composed of any of the diols (1-1) and a small amount of any of the trihydric or higher polyols (1-2).

Examples of the diols (1-1) include alkylene glycols (ethylene glycol, 1,2-propylene glycol, 1,3-propylene glycol, 1,4-butanediol, 1,6-hexanediol, etc); alkylene ether glycols (diethylene glycol, triethylene glycol, dipropylene glycol, polyethylene glycol, polypropylene glycol, polytetramethylene ether glycol, etc.); alicyclic diols (1,4-cyclohexanedimethanol, hydrogenated bisphenol A, etc.); bisphenols (bisphenol A, bisphenol F, bisphenol S, etc.); alkylene oxide (ethylene oxide, propylene oxide, butylene oxide, etc.) adducts of the alicyclic diols; and alkylene oxide (ethylene oxide, propylene oxide, butylene oxide, etc.) adducts of the bisphenols. Of these, preference is given to alkylene glycols having 2 to 12 carbon atoms, and alkylene oxide adducts of bisphenols, and greater preference is given to alkylene oxide adducts of bisphenols, and combinations of the alkylene oxide adducts of bisphenols and alkylene glycols having 2 to 12 carbon atoms.

Examples of the trihydric or higher polyols (1-2) include trihydric to octahydric or higher aliphatic alcohols (glycerin, trimethylolethane, trimethylolpropane, pentaerythritol, sorbitol, etc.); trihydric or higher phenols (trisphenol PA, phenol novolac, cresol novolac, etc.); and alkylene oxide adducts of the trihydric or higher phenols.

Examples of the polycarboxylic acid (2) include dicarboxylic acids (2-1) and trivalent or higher polycarboxylic acids (2-2), and it is preferable to use any of the dicarboxylic acids (2-1) alone, or mixtures each composed of any of the dicarboxylic acids (2-1) and a small amount of any of the trivalent or higher polycarboxylic acids (2-2).

Examples of the dicarboxylic acids (2-1) include alkylene dicarboxylic acids (succinic acid, adipic acid, sebacic acid, etc.); alkenylene dicarboxylic acids (maleic acid, fumaric acid, etc.); and aromatic dicarboxylic acids (phthalic acid, isophthalic acid, terephthalic acid, naphthalenedicarboxylic acid, etc.). Of these, preference is given to alkenylene dicarboxylic acids having 4 to 20 carbon atoms and aromatic dicarboxylic acids having 8 to 20 carbon atoms.

Examples of the trivalent or higher polycarboxylic acids (2-2) include aromatic polycarboxylic acids (trimellitic acid, pyromellitic acid, etc.) having 9 to 20 carbon atoms. Additionally, the polycarboxylic acid (2) may be obtained by reaction between the polyol (1) and anhydrides or lower alkyl esters (methyl ester, ethyl ester, isopropyl ester, etc.) of the above-mentioned compounds.

As for the proportion of the polyol (1) to the polycarboxylic acid (2), the equivalence ratio [OH]/[COOH] of the hydroxyl group [OH] to the carboxyl group [COOH] is normally in the range of 2/1 to 1/1, preferably in the range of 1.5/1 to 1/1, more preferably in the range of 1.3/1 to 1.02/1.

Examples of the polyisocyanate (3) include aliphatic polyisocyanates (tetramethylene diisocyanate, hexamethylene diisocyanate, 2,6-diisocyanatomethyl caproate, etc.); alicyclic polyisocyanates (isophorone diisocyanate, cyclohexylmethane diisocyanate, etc.); aromatic diisocyanates (tolylene diisocyanate, diphenylmethane diisocyanate, etc.); aromatic aliphatic diisocyanates (α,α,α',α'-tetramethylxylylene diisocyanate, etc.); isocyanurates; and the polyisocyanates blocked with phenol derivatives, oximes, caprolactam, etc. These may be used alone or in combination.

As for the proportion of the polyisocyanate (3) to the polyester, the equivalence ratio [NCO]/[OH] of the isocyanate group [NCO] to the hydroxyl group [OH] of the hydroxyl group-containing polyester is normally in the range of 5/1 to 1/1, preferably in the range of 4/1 to 1.2/1, more preferably in the range of 2.5/1 to 1.5/1. When the equivalence ratio [NCO]/[OH] is greater than 5, there is a decrease in low-temperature fixing ability. When the isocyanate group [NCO] is less than 1 in molar ratio, the amount of urea contained in the modified polyester is small, adversely affecting resistance to hot offset.

The amount of components of the polyisocyanate (3) contained in the isocyanate-terminated prepolymer (A) is preferably 0.5% by mass to 40% by mass, more preferably 1% by mass to 30% by mass, even more preferably 2% by mass to 20% by mass. When the amount is less than 0.5% by mass, there is a decrease in resistance to hot offset and there is a disadvantage in satisfying both heat-resistant storage ability and low-temperature fixing ability. When the amount is greater than 40% by mass, there is a decrease in low-temperature fixing ability.

The number of isocyanate groups contained per molecule in the isocyanate group-containing prepolymer (A) is preferably 1 or more, more preferably 1.5 to 3 on average, even more preferably 1.8 to 2.5 on average. When the number of the isocyanate groups per molecule is less than 1 on average, the molecular mass of the urea-modified polyester is low, and thus there is a decrease in resistance to hot offset.

Examples of the amines (B) include diamines (B1), trivalent or higher polyamines (B2), amino alcohols (B3), amino mercaptans (B4), amino acids (B5), and compounds (B6) obtained by blocking amino groups of (B1) to (B5). Examples of the diamines (B1) include aromatic diamines such as phenylenediamine, diethyltoluenediamine, 4,4'-diaminodiphenylmethane, etc.; alicyclic diamines such as 4,4'-diamino-3,3'-dimethyldicyclohexylmethane, diaminecyclohexane, isophoronediamine, etc.; and aliphatic diamines such as ethylenediamine, tetramethylenediamine, hexamethylenediamine, etc. Examples of the trivalent or higher polyamines (B2) include diethylenetriamine and triethylenetetramine. Examples of the amino alcohols (B3) include ethanolamine and hydroxyethylaniline. Examples of the amino mercaptans (B4) include aminoethyl mercaptan and aminopropyl mercaptan. Examples of the amino acids (B5) include aminopropionic acid and aminocaproic acid. Examples of the compounds (B6) obtained by blocking amino groups of (B1) to (B5), include oxazoline compounds and ketimine compounds derived from the amines of (B1) to (B5) and ketones such as acetone, methy ethyl ketone, methyl isobutyl ketone, etc. Of these amines (B), preference is given to the diamines (B1), and mixtures each composed of any of the diamines (B1) and a small amount of any of the trivalent or higher polyamines (B2).

Further, an elongation terminator may be used so as to adjust the molecular mass of the urea-modified polyester, if necessary. Examples of the elongation terminator include monoamines such as diethylamine, dibutylamine, butylamine, laurylamine, etc., and compounds such as ketimine compounds obtained by blocking the monoamines.

As for the proportion of the amine (B), the equivalence ratio [NCO]/[NHx] of the isocyanate group [NCO] in the isocyanate group-containing prepolymer (A) to the amino group [NHx] in the amine (B) is preferably in the range of 1/2 to 2/1, more preferably in the range of 1.5/1 to 1/1.5, even more preferably in the range of 1.2/1 to 1/1.2. When the equivalence ratio [NCO]/[NHx] is greater than 2 or less than 1/2, the molecular mass of the urea-modified polyester (i) is low, and thus there is a decrease in resistance to hot offset.

In the present invention, the urea-modified polyester (i) may contain a urethane bond as well as a urea bond. The molar ratio of the amount of the urea bond to the amount of the urethane bond is preferably in the range of 100/0 to 10/90, more preferably in the range of 80/20 to 20/80, even more preferably in the range of 60/40 to 30/70. When the urea bond is less than 10% in molar ratio, there is a decrease in resistance to hot offset.

By the above-mentioned reactions, a modified polyester, particularly the urea-modified polyester (i), used in the toner of the present embodiment can be produced. The urea-modified polyester (i) is produced by a one-shot method or a prepolymer method. The mass average molecular mass of the urea-modified polyester (i) is preferably 10,000 or greater, more preferably 20,000 to 10,000,000, even more preferably 30,000 to 1,000,000. When it is less than 10,000, there is a decrease in resistance to hot offset.

The number average molecular mass of the urea-modified polyester is not particularly limited when the below-mentioned unmodified polyester (ii) is additionally used; it may be such a number average molecular mass as help to obtain the above-mentioned mass average molecular mass. When the urea-modified polyester (i) is solely used, its number average molecular mass is preferably 20,000 or less, more preferably 1,000 to 10,000, even more preferably 2,000 to 8,000. When it is greater than 20,000, there is a decrease in low-temperature fixing ability, and in the case of using in a full-color image forming apparatus, there is a decrease in glossiness.

In the present embodiment, instead of solely using the urea-modified polyester (i), an unmodified polyester (ii) may be additionally used as a binder resin component together with the urea-modified polyester (i). The use of the unmodified polyester (ii) together with the urea-modified polyester (i) is preferable to the use of the urea-modified polyester (i) alone because there is an increase in low-temperature fixing ability, and in the case of using in a full-color apparatus, there is an increase in glossiness. Examples of the unmodified polyester (ii) include a polycondensate of a polyol (1) and a polycarboxylic acid (2) similar to the components of the urea-modified polyester (i), and suitable examples thereof are also similar to those suitable for the urea-modified polyester (i). The polyester (ii) does not necessarily have to be an unmodified polyester and may be a polyester modified with a chemical bond other than urea bond, for example urethane bond. It is desirable in terms of low-temperature fixing ability and resistance to hot offset that the urea-modified polyester (i) and the polyester (ii) be compatible with each other at least partially.

Accordingly, it is desirable that the urea-modified polyester (i) and the polyester (ii) have similar compositions. When the polyester (ii) is used, the mass ratio of the urea-modified polyester (i) to the polyester (ii) is preferably in the range of 5/95 to 80/20, more preferably in the range of 5/95 to 30/70, even more preferably in the range of 5/95 to 25/75, particularly preferably in the range of 7/93 to 20/80. When the mass ratio of the urea-modified polyester (i) is less than 5% by mass, there is a decrease in resistance to hot offset and there is a disadvantage in satisfying both the heat-resistant storage ability and the low-temperature fixing ability.

The peak molecular mass of the polyester (ii) is preferably 1,000 to 30,000, more preferably 1,500 to 10,000, even more preferably 2,000 to 8,000. When it is less than 1,000, there is a decrease in heat-resistant storage ability. When it is greater than 10,000, there is a decrease in low-temperature fixing ability. The hydroxyl value of the polyester (ii) is preferably 5 or greater, more preferably 10 to 120, even more preferably 20 to 80. When the hydroxyl value is less than 5, there is a disadvantage in satisfying both the heat-resistant storage ability and the low-temperature fixing ability. The acid value of the polyester (ii) is preferably 1 to 30, more preferably 5 to 20. With such an acid value, the polyester (ii) tends to be negatively charged.

The glass transition temperature (Tg) of the binder resin is preferably 50° C. to 70° C., more preferably 55° C. to 65° C. When it is lower than 50° C., toner blocking worsens when the toner is stored at a high temperature. When it is higher than 70° C., the low-temperature fixing ability is insufficient. Due to the presence of the urea-modified polyester together with the binder resin, the toner used in the present invention tends to be superior in heat-resistant storage ability to known polyester toners even if the toner has a low glass transition point.

As for the storage elastic modulus of the binder resin, the temperature (TG') at which it is 10,000 dyne/cm$^2$, at a measurement frequency of 20 Hz, is preferably 100° C. or higher, more preferably 110° C. to 200° C. When the temperature (TG') is lower than 100° C., there is a decrease in resistance to hot offset.

As for the viscosity of the binder resin, the temperature (Tη) at which it is 1,000 P, at a measurement frequency of 20 Hz, is normally 180° C. or lower, preferably 90° C. to 160° C. When the temperature is higher than 180° C., there is a decrease in low-temperature fixing ability. Accordingly, it is desirable that TG' be higher than Tη, in terms of satisfying both low-temperature fixing ability and resistance to hot offset. In other words, the difference between TG' and Tη(TG'−Tη) is preferably 0° C. or greater, more preferably 10° C. or greater, even more preferably 20° C. or greater. The upper limit of the difference between TG' and Tη is not particularly limited. Also, it is desirable that the difference between Tη and Tg be preferably 0° C. to 100° C., more preferably 10° C. to 90° C., even more preferably 20° C. to 80° C., in terms of satisfying both the heat-resistant storage ability and the low-temperature fixing ability.

The binder resin is produced by the following method or the like.

Firstly, the polyol (1) and the polycarboxylic acid (2) are heated at a temperature of 150° C. to 280° C. in the presence of a known esterification catalyst such as tetrabutoxy titanate or dibutyltin oxide, then water produced is distilled away, with a reduction in pressure if necessary, and a hydroxyl group-containing polyester is thus obtained. Subsequently, the polyester is reacted with the polyisocyanate (3) at a temperature of 40° C. to 140° C. so as to obtain an isocyanate group-containing prepolymer (A). Further, the prepolymer (A) is reacted with an amine (B) at a temperature of 0° C. to 140° C. so as to obtain a urea-modified polyester. When the polyester is reacted with the polyisocyanate (3) and when the prepolymer (A) is reacted with the amine (B), solvent may be used if necessary.

Examples of usable solvents include aromatic solvents such as toluene, xylene, etc.; ketones such as acetone, methyl ethyl ketone, methyl isobutyl ketone, etc.; esters such as ethyl acetate, etc.; amides such as dimethylformamide, dimethylacetamide, etc.; and ethers such as tetrahydrofuran, etc., which are inactive to the polyisocyanate (3).

In the case where the polyester (ii) which is not modified with a urea bond is additionally used, the polyester (ii) is produced in a manner similar to the production of the hydroxyl group-containing polyester, and the polyester (ii) is dissolved and mixed in a solution of the above-mentioned urea-modified polyester (i) in which reaction has been finished.

Generally, the toner used in the present embodiment can be produced by the following method. However, other methods may be employed instead.

Toner particles may be formed in the aqueous medium by reaction between the amine (B) and a dispersion of the isocyanate group-containing prepolymer (A) or by using the urea-modified polyester (i) produced in advance. As a method for stably forming the dispersion of the prepolymer (A) and/or the urea-modified polyester (i) in an aqueous medium, there is, for example, a method of adding a toner material composition which includes the prepolymer (A) or the urea-modified polyester (i) into the aqueous medium and dispersing the composition by shearing force.

The prepolymer (A) and other toner compositions (hereinafter referred to as "toner materials") such as a colorant, a colorant master batch, a releasing agent, a charge controlling agent and an unmodified polyester resin may be mixed together when the dispersion is formed in the aqueous medium; it is, however, more preferred that the toner materials be mixed together in advance, then the mixture is added and dispersed into the aqueous medium. Also in the present invention, the other toner materials such as the colorant, the releasing agent and the charge controlling agent do not necessarily have to be mixed when the particles are formed in the aqueous medium; the other toner materials may be added after the particles have been formed. For instance, particles which do not contain the colorant have been formed, and then the colorant may be added in accordance with a known dyeing method.

The aqueous medium may be composed solely of water or composed of water and a solvent miscible with water. Examples of the solvent miscible with water include alcohols such as methanol, isopropanol, ethylene glycol, etc.; dimethylformamide; tetrahydrofuran; cellusolves such as methyl cellusolve, etc.; and lower ketones such as acetone, methyl ethyl ketone, etc.

The amount of the aqueous medium used is preferably 50 parts by mass to 2,000 parts by mass, more preferably 100 parts by mass to 1,000 parts by mass, relative to 100 parts by mass of the toner composition which includes the prepolymer (A) and/or the urea-modified polyester (i). When the amount is less than 50 parts by mass, the toner composition is poorly dispersed, and thus toner particles having a predetermined diameter cannot be obtained. When the amount is greater than 2,000 parts by mass, it is not preferable from an economical point of view.

Additionally, a dispersant may be used if necessary. Use of a dispersant is preferable in that the particle size distribution becomes sharper and the dispersion can be stabilized.

The dispersing method is not particularly limited, and known devices may be used in the method. Examples thereof include those using low-speed shearing dispersion, high-speed shearing dispersion, frictional dispersion, high-pressure jet dispersion and ultrasonic dispersion. The high-speed shearing dispersion is preferably used so as to form a dispersion having a particle diameter of 2 μm to 20 μm. In the case where a high-speed shearing dispersing machine is used, the rotational speed is not particularly limited, and it is preferably 1,000 rpm to 30,000 rpm, more preferably 5,000 rpm to 20,000 rpm. The length of time for which the dispersion lasts is not particularly limited, and it is normally 0.1 min to 5 min when a batch method is employed. The temperature for dispersion is preferably 0° C. to 150° C. (under pressure), more preferably 40° C. to 98° C. High temperatures are preferable in that the dispersion of the prepolymer (A) and/or the urea-modified polyester (i) has a low viscosity so as to be easily dispersed.

As to a process of synthesizing the urea-modified polyester (1) from the prepolymer (A), the amine (B) may be added so as to be reacted therewith, before the toner composition is dispersed in the aqueous medium; alternatively, the amine (B) may be added after the toner composition has been dispersed in the aqueous medium, allowing reaction to occur from particle interfaces. In this case, the urea-modified polyester may be preferentially formed on the surface of the toner produced, and a concentration gradient may be thus provided inside toner particles.

In the reaction, a dispersant may be preferably used as necessary.

The dispersant is not particularly limited and may be appropriately selected depending on the intended purpose. Examples thereof include surfactants, dispersants composed of an inorganic compound sparingly soluble in water, polymeric protective colloids. These may be used alone or in combination. Of these, surfactants are preferable.

Examples of the surfactants include anionic surfactants, cationic surfactants, nonionic surfactants and amphoteric surfactants.

Examples of the anionic surfactants include alkylbenzene sulfonate, α-olefin sulfonate, and phosphoric ester. Of these, fluoroalkyl group-containing surfactants are preferably used. Examples of the fluoroalkyl group-containing anionic surfactants include fluoroalkyl carboxylic acids having 2 to 10 carbon atoms, and metal salts thereof, disodium perfluorooctanesulfonylglutamate, sodium 3-[ω-fluoroalkyl (C6 to C11) oxy]-1-alkyl (C3 to C4) sulfonate, sodium 3-[ω-fluoroalkanoyl (C6 to C8)-N-ethylamino]-1-propanesulfonate, fluoroalkyl (C11 to C20) carboxylic acids and metal salts thereof, perfluoroalkylcarboxylic acids (C7 to C13) and metal salts thereof, perfluoroalkyl (C4 to C12) sulfonic acids and metal salts thereof, perfluorooctanesulfonic acid diethanolamide, N-propyl-N-(2-hydroxyethyl)perfluorooctanesulfonamide, perfluoroalkyl (C6 to C10) sulfonamide propyltrimethylammonium salts, perfluoroalkyl (C6 to C10)-N-ethylsulfonylglycine salts and monoperfluoroalkyl (C6 to C16) ethyl phosphoric acid esters. Examples of commercially available products of the fluoroalkyl group-containing surfactants include SURFLON S-111, S-112 and S-113 (produced by Asahi Glass Co., Ltd.); FLUORAD FC-93, FC-95, FC-98 and FC-129 (produced by Sumitomo 3M Limited); UNIDYNE DS-101 and DS-102 (produced by DAIKIN INDUSTRIES, LTD.); MEGAFACE F-110, F-120, F-113, F-191, F-812 and F-833 (produced by Dainippon Ink And Chemicals, Incorporated); EFTOP EF-102, 103, 104, 105, 112, 123A, 123B, 306A, 501, 201 and 204 (produced by Tochem Products Co., Ltd.); and FTERGENT F-100 and F150 (produced by NEOS COMPANY LIMITED).

Examples of the cationic surfactants include amine salt surfactants, and cationic surfactants of quaternary ammonium salt. Examples of the amine salt cationic surfactants include alkylamine salts, aminoalcohol fatty acid derivatives, polyamine fatty acid derivatives and imidazoline. Examples of the quaternary ammonium salt cationic surfactants include alkyltrimethyl ammonium salts, dialkyl dimethyl ammonium salts, alkyl dimethyl benzyl ammonium salts, pyridinium salts, alkyl isoquinolinium salts and benzetonium chloride. Examples of cationic surfactants include fluoroalkyl group-containing aliphatic primary, secondary or tertiary amine acids, aliphatic quaternary ammonium salts such as perfluoroalkyl (C6 to C10) sulfonamide propyltrimethylammonium salts, benzalkonium salts, benzetonium chloride, pyridinium salts and imidazolinium salts. Examples of the commercially available products of the cationic surfactants include SURFLON S-121 (produced by Asahi Glass Co., Ltd.), FLUORAD FC-135 (produced by Sumitomo 3M Limited), UNIDYNE DS-202 (produced by DAIKIN INDUSTRIES, LTD.), MEGAFACE F-150 and F-824 (produced by Dainippon Ink And Chemicals, Incorporated), EFTOP EF-132 (produced by Tochem Products Co., Ltd.), and FTERGENT F-300 (produced by NEOS COMPANY LIMITED).

Examples of the nonionic surfactants include fatty acid amide derivatives and polyhydric alcohol derivatives.

Examples of the amphoteric surfactants include alanine, dodecyldi(aminoethyl)glycine, di(octylaminoethyl)glycine and N-alkyl-N,N-dimethylammoniumbetaine.

Also, as inorganic compound dispersants sparingly soluble in water, tricalcium phosphate, calcium carbonate, titanium oxide, colloidal silica, hydroxyappetite and the like may be used.

Examples of the polymeric protection colloids include acids, (meth)acrylic monomers containing hydroxyl groups, vinyl alcohol or ethers of vinyl alcohol, esters of vinyl alcohol with a compound having a carboxyl group, amide compounds or methylol compounds thereof, chlorides, homopolymers or copolymers such as those containing nitrogen atoms or heterocycles thereof, polyoxyethylenes, and celluloses.

Examples the acids include acrylic acid, methacrylic acid, α-cyanoacrylic acid, α-cyanomethacrylic acid, itaconic acid, crotonic acid, fumaric acid, maleic acid and maleic anhydride. Examples of the hydroxyl group-containing (meth) acrylic monomers include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylolacrylamide and N-methylolmethacrylamide. Examples of the vinyl alcohol and ethers of vinyl alcohol include vinyl methyl ether, vinyl ethyl ether and vinyl propyl ether. Examples of the esters of carboxyl group-containing compounds and vinyl alcohol include vinyl acetate, vinyl propionate and vinyl butyrate. Examples of the amide compounds or methylol compounds thereof include the acrylamide, methacrylamide, diacetone acrylamide, and methylol compounds thereof. Examples of the chlorides include acrylic acid chlorides and methacrylic acid chloride. Examples of the homopolymers or copolymers such as those containing nitrogen atoms or heterocycles thereof include vinyl pyridine, vinyl pyrolidone, vinyl imidazole and ethyleneimine. Examples of the polyoxyethylenes include polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester and polyoxyethylene nonyl phenyl ester. Examples of the celluloses include methyl cellulose, hydroxyethyl cellulose and hydroxypropyl cellulose.

In preparation of the dispersion, a dispersion stabilizer may be used as necessary.

Examples of the dispersion stabilizers include those soluble in acid and alkali, such as calcium phosphate.

In the case of using the dispersion stabilizers, calcium phosphate can be removed from fine particles by a method in which calcium phosphate is dissolved in an acid such as hydrochloric acid and washed with water, or a method of being decomposed with enzymes.

In preparation of the dispersion, catalysts for the elongation reaction and/or the cross-linking reaction may be used. Examples of the catalysts include dibutyltin laurate and dioctyltin laurate.

Further, to reduce the viscosity of the toner composition, a solvent may be used in which the urea-modified polyester (i) and/or the prepolymer (A) are/is soluble. Use of the solvent is preferable in that the particle size distribution becomes sharper. The solvent is preferable in terms of easy removal, because it is volatile.

Examples of the solvent include toluene, xylene, benzene, carbon tetrachloride, methylene chloride, 1,2-dichloroethane, 1,1,2-trichloroethane, trichloroethylene, chloroform, monochloro benzene, dichloroethylidene, methyl acetate, ethyl acetate, methyl ethyl ketone and methyl isobutyl ketone. These may be used alone or in combination. Of these, preferred are aromatic solvents such as toluene and xylene, and halogenated hydrocarbons such as methylene chloride, 1,2-dichloroethane, chloroform and carbon tetrachloride, with particular preference being given to aromatic solvents such as toluene and xylene.

The amount of the solvent used is preferably 0 parts by mass to 300 parts by mass, more preferably 0 parts by mass to 100 parts by mass, even more preferably 25 parts by mass to 70 parts by mass, relative to 100 parts by mass of the prepolymer (A). In the case where the solvent is used, it is removed by heating under normal or reduced pressure after elongation and/or cross-linkage.

The length of time for which the elongation and/or the cross-linkage lasts is selected according to the reactivity between the isocyanate group structure of the prepolymer (A) and the amine (B) and is preferably in the range of 10 min to 40 hr, more preferably in the range of 2 hr to 24 hr. The reaction temperature is preferably in the range of 0° C. to 150° C., more preferably in the range of 40° C. to 98° C. Additionally, a known catalyst may be used if necessary. Specific examples thereof include dibutyltin laurate and dioctyltin laurate.

To remove an organic solvent from the emulsified dispersion obtained, a method can be employed in which the entire system is gradually increased in temperature and the organic solvent in droplets is completely removed by evaporation. Alternatively, by spraying the emulsified dispersion into a dry atmosphere and completely removing a water-insoluble organic solvent from droplets, fine toner particles can be formed, and also, an aqueous dispersant can be removed by evaporation. Generally, examples of the dry atmosphere into which the emulsified dispersion is sprayed include gases such as air, nitrogen, carbonic acid gas and combustion gas which have been heated, especially flow of gasses heated to a temperature higher than or equal to the boiling point of the solvent used that has the highest boiling point. A dry atmosphere of highly desired quality can be obtained by a short-time process with a spray dryer, a belt dryer, a rotary kiln or the like.

In the case where the dispersion has a wide particle size distribution at the time of emulsification and dispersion, and washing and drying processes are carried out with the particle size distribution kept unchanged, it is possible to adjust the particle size distribution such that particles are classified according to a desired particle size distribution.

As to the classification, fine particles can be removed by a cyclone separator, a decanter, a centrifuge, etc. in liquid. The classification may be carried out after particles have been obtained as powder through drying; nevertheless, it is desirable in terms of efficiency that the classification be carried out in liquid. Unnecessary fine or coarse particles produced may be returned to a kneading process again so as to be used for formation of particles. In this case, the unnecessary fine or coarse particles may be in a wet state.

It is desirable that the dispersant used be removed from the obtained dispersion solution as much as possible and at the same time as the classification.

By mixing the obtained dried toner powder with different particles such as releasing agent fine particles, charge controlling fine particles, fluidizer fine particles and colorant fine particles and mechanically impacting the mixed powder, the different particles are fixed to and fused with the particle surface and thus it is possible to prevent detachment of the different particles from the surface of the composite particles obtained.

As specific method of performing the foregoing, there are, for example, (1) a method of impacting the mixture, using a blade which rotates at high speed, and (2) a method of pouring the mixture into a high-speed gas flow, accelerating the speed of the mixture and allowing particles to collide with one another or composite particles to collide with a certain plate. Examples of apparatuses for performing the foregoing include apparatuses in which the pulverization air pressure is reduced, made by modifying I-TYPE MILL (manufactured by Nippon Pneumatic Mfg. Co., Ltd.) and ANGMILL (manufactured by Hosokawa Micron Group); HYBRIDIZATION SYSTEM (manufactured by NARA MACHINERY CO., LTD.); KRYPTRON SYSTEM (manufactured by Kawasaki Heavy Industries, Ltd.); and automatic mortars.

Examples of the colorant used for the toner include pigments and dyes conventionally used as colorants for toners. Specific examples thereof include carbon black, lamp black, iron black, ultramarine, nigrosine dyes, aniline blue, phthalocyanine blue, phthalocyanine green, Hansa Yellow G, Rhodamine 6C Lake, chalco oil blue, chrome yellow, quinacridone red, benzidine yellow and rose bengal. These may be used alone or in combination.

Further, if necessary, magnetic components may be included alone or in combination in toner particles in order for the toner particles themselves to have magnetic properties. Examples of the magnetic components include iron oxides such as ferrite, magnetite and maghemite, metals such as iron, cobalt and nickel, and alloys composed of these and other metals. Also, these components may be used as colorant components.

Also, the number average particle diameter of the colorant in the toner used in the present invention is preferably 0.5 μm or less, more preferably 0.4 μm or less, even more preferably 0.3 μm or less.

When the number average particle diameter of the colorant in the toner is greater than 0.5 μm, the dispersibility of the pigment is insufficient, and thus favorable transparency cannot be obtained in some cases. When the number average particle diameter of the colorant is less than 0.1 μm, i.e., a minute particle diameter, it is far smaller than the half wavelength of visible light; thus, it is thought that the colorant does not have an adverse effect on light-reflecting and -absorbing properties. Therefore, the colorant particles having a number average particle diameter of less than 0.1 μm contribute to favorable color reproducibility and transparency of an OHP sheet with a fixed image. Meanwhile, when there are many colorant particles having a number average particle diameter of greater than 0.5 μm, transmission of incident light is disturbed and/or the incident light is scattered, and thus a projected image on an OHP sheet tends to decrease in brightness and saturation. Moreover, the presence of many colorant particles which are greater than 0.5 μm in diameter is not preferable because the colorant particles easily detach from the toner particle surface, causing problems such as fogging, smearing of the drum and cleaning failure. It should be particularly noted that colorant particles having a number average particle diameter of greater than 0.7 μm preferably occupy 10% by number or less, more preferably 5% by number or less, of all colorant particles.

By kneading the colorant together with part or all of a binder resin in advance with the addition of a wetting liquid, the colorant and the binder resin are sufficiently attached to each other at an early stage, the colorant is effectively dispersed in toner particles in a subsequent toner production process, the dispersed particle diameter of the colorant becomes small, and thus more excellent transparency can be obtained.

For the binder resin kneaded together with the colorant in advance, any of the resins shown above as examples of the binder resins for the toner can be used without change, but the binder resin is not limited thereto.

As a specific method of kneading a mixture of the colorant and the binder resin in advance with the addition of the wetting liquid, there is, for example, a method in which the colorant, the binder resin and the wetting liquid are mixed together using a blender such as a HENSCHEL MIXER, then the obtained mixture is kneaded at a temperature lower than the melting temperature of the binder resin, using a kneading machine such as a two-roll machine or three-roll machine, and a sample is thus obtained.

For the wetting liquid, those commonly used may be used, in view of the solubility of the binder resin and the wettability thereof with the colorant; water and organic solvents such as acetone, toluene and butanone are preferable in terms of the colorant's dispersibility. Of these, water is particularly preferably used in terms of the environment care and maintenance of the colorant's dispersion stability in the subsequent toner production process.

With the use of this production method, not only colorant particles contained in the obtained toner are small in diameter, but also the particles are in a highly uniform dispersed state, so that the color reproducibility of an image projected by an OHP can be further improved.

A releasing agent may be preferably contained along with the binder resin and the colorant in the toner.

The releasing agent is not particularly limited and may be appropriately selected from those known in the art depending on the intended purpose. Examples thereof include polyolefin waxes such as polyethylene wax, polypropylene wax, etc., long-chain hydrocarbons such as paraffin wax, Sasolwax, etc., and carbonyl group-containing waxes. Of these, carbonyl group-containing waxes are preferable.

Examples the carbonyl group-containing waxes include polyalkanoic acid esters such as carnauba wax, montan wax, trimethylolpropane tribehenate, pentaerythritol tetrabehenate, pentaerythritol diacetate dibehenate, glycerin tribehenate, 1,18-octadecanediol distearate, etc.; polyalkanol esters such as tristearyl trimellitate, distearyl maleate, etc; polyalkanoic acid amides such as ethylenediamine dibehenyl amide, etc.; polyalkylamides such as trimellitic acid tristearyl amide, etc.; and dialkyl ketones such as distearyl ketone, etc. Of these carbonyl group-containing waxes, preference is given to polyalkanoic acid esters.

The melting point of the releasing agent is preferably 40° C. to 160° C., more preferably 50° C. to 120° C., even more preferably 60° C. to 90° C. Waxes having a melting point of lower than 40° C. adversely affect heat-resistant storage ability, and waxes having a melting point of higher than 160° C. are likely to cause cold offset when toner is fixed at a low temperature.

The melt viscosity of the releasing agent is preferably 5 cps to 1,000 cps, more preferably 10 cps to 100 cps, when measured at a temperature higher than the melting point by 20° C. The releasing agent having a melt viscosity higher than 1,000 cps are not much effective in improving low-temperature fixing ability and resistance to hot offset.

The amount of the releasing agent contained in the toner is preferably 0% by mass to 40% by mass, more preferably 3% by mass to 30% by mass.

Additionally, to adjust the charged amount of the toner and allow toner particles to rise quickly upon charging, a charge controlling agent may be contained in the toner if necessary. Here, when a colored material is used as the charge controlling agent, there is a change in color, so that use of a material which is colorless or whitish is preferable.

As the charge controlling agent is not particularly limited and may be appropriately selected from those known in the art depending on the intended purpose. Examples thereof include triphenylmethane dyes, molybdic acid chelate pigments, rhodamine dyes, alkoxy amines, quaternary ammonium salts (including fluorine-modified quaternary ammonium salts), alkylamides, phosphorus and compounds thereof, tungsten and compounds thereof, fluorine activators, metal salts of salicylic acid and metal salts of salicylic acid derivatives.

As the charge controlling agent, commercially available products can be used. Specific examples thereof include BONTRON P-51 as a quaternary ammonium salt, E-82 as an oxynaphthoic acid metal complex, E-84 as a salicylic acid metal complex, and E-89 as a phenolic condensate (manufactured by Orient Chemical Industries); TP-302 and TP-415 as quaternary ammonium salt molybdenum complexes (manufactured by Hodogaya Chemical Industries); COPY CHARGE PSY VP2038 as a quaternary ammonium salt, COPY BLUE PR as a triphenylmethane derivative, and COPY CHARGE NEG VP2036 and COPY CHARGE NX VP434 as quaternary ammonium salts (manufactured by Hoechst); LRA-901, and LR-147 as a boron complex (manufactured by Japan Carlit Co., Ltd.); quinacridone, azo pigments; and polymeric compounds containing functional groups such as sulfonic acid group, carboxyl group and quaternary ammonium salt.

The amount of the charge controlling agent used is decided according to the type of the binder resin, the presence or absence of an additive used if necessary, and the toner production method including the dispersing method and so not unequivocally limited; however, the amount is in the range of 0.1 parts by mass to 10 parts by mass, preferably in the range of 0.2 parts by mass to 5 parts by mass, relative to 100 parts by mass of the binder resin. When the amount of the charge controlling agent is greater than 10 parts by mass, the chargeability of the toner is so great that effects of the charge controlling agent are reduced, and there is an increase in electrostatic suction toward a developing roller, causing a decrease in the fluidity of a developer and a decrease in image density. Such a charge controlling agent may be dissolved and dispersed in the toner after melted and kneaded together with a master batch and a resin, or may be directly added into an organic solvent when dissolved and dispersed therein, or may be fixed on the toner particle surface after the formation of toner particles.

When the toner composition is dispersed in the aqueous medium in the toner production process, fine resin particles mainly for stabilizing the dispersion may be added.

For the fine resin particles, any resin may be used as long as it can form an aqueous dispersion. The resin may be a thermoplastic resin or a thermosetting resin. Examples thereof include vinyl resins, polyurethane resins, epoxy resins, polyester resins, polyamide resins, polyimide resins, silicon resins, phenol resins, melamine resins, urea resins, aniline resins, ionomer resins and polycarbonate resins. These may be used alone or in combination. Of these resins, preference is given to vinyl resins, polyurethane resins, epoxy resins, polyester resins, and combinations thereof because an aqueous dispersion of fine spherical resin particles can be easily obtained.

As the vinyl resins, polymers each produced by homopolymerizing or copolymerizing a vinyl monomer are used. Examples thereof include, but not limited to, styrene-(meth) acrylate resins, styrene-butadiene copolymers, (meth)acrylic acid-acrylate copolymers, styrene-acrylonitrile copolymers, styrene-maleic anhydride copolymers and styrene-(meth) acrylate copolymers.

Further, fine inorganic fine particles are preferably used as an external additive to support the fluidity, developing ability and chargeability of toner particles.

Specific examples of the fine inorganic fine particles include silica, alumina, titanium oxide, barium titanate, magnesium titanate, calcium titanate, strontium titanate, zinc oxide, tin oxide, silica sand, clay, mica, wollastonite, diatom earth, chrome oxide, cerium oxide, red ochre, antimony trioxide, magnesium oxide, zirconium oxide, barium sulfate, barium carbonate, calcium carbonate, silicon carbide and silicon nitride.

The fine inorganic fine particles preferably have a primary particle diameter of 0.005 μm to 2 μm each, more preferably 0.005 μm to 0.5 μm each. Also, the fine inorganic fine particles preferably have a BET specific surface area of 20 $m^2/g$ to 500 $m^2/g$. The amount of the fine inorganic fine particles in the toner is preferably occupy 0.01% by mass to 5% by mass, more preferably 0.01% by mass to 2.0% by mass.

Moreover, examples thereof include fine polymer particles exemplified by polymer particles of thermosetting resins, polycondensates such as nylons, benzoguanamine and silicones, acrylic acid ester copolymers, methacrylic acid ester copolymers and polystyrene obtained by soap-free emulsion polymerization, suspension polymerization or dispersion polymerization.

Moreover, a fluidizer can be added to the toner. With the use of the fluidizer, the toner particles can be surface treated so as to increase their hydrophobicity, thereby preventing a decrease in the fluidity and chargeability of the toner particles even at high humidity. Suitable examples of the fluidizer include silane coupling agents, silylating agents, fluorinated alkyl group-containing silane coupling agents, organic titanate coupling agents, aluminum coupling agents, silicone oils and modified silicone oils.

Examples of a cleanability enhancer for removing a developer which remains on the photoconductor or the intermediate transfer medium, after image transfer, include fatty acid metal salts such as zinc stearate, calcium stearate and stearic acid; and fine polymer particles produced by soap-free emulsion polymerization or the like, such as fine polymethyl methacrylate particles and fine polystyrene particles. The fine polymer particles have a relatively narrow particle size distribution, and those which are 0.01 μm to 1 μm in a volume average particle diameter are preferable.

By the use of such toner a high-quality visible image excellent in developing stability can be formed, as described above.

Moreover, the image forming apparatus of the present invention can be used with a pulverized toner having an indefinite particle shape as well as with the above-mentioned toner obtained by a polymerization method suitable for obtaining high-quality images, and the lifetime of the apparatus can be greatly lengthened. As the material for such a pulverized toner, any material usually used for electrophotographic toner can be used without any limitation in particular.

Examples of binder resins commonly used for the pulverized toner include, but not limited to, homopolymers of styrene and its substitution polymers, such as polystyrene, poly-p-chlorostyrene and polyvinyl toluene; styrene copolymers such as styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-α-methyl chlormethacrylate copolymers, styrene-acrylonitrile copolymers, styrene-vinyl methyl ketone copolymers, styrene-butadiene copolymers, styrene-isoprene copolymers and styrene-maleic acid copolymers; homopolymers and copolymers of acrylic acid esters, such as polymethyl acrylate, polybutyl acrylate, polymethyl methacrylate and polybutyl methacrylate; polyvinyl derivatives such as polyvinyl chloride and polyvinyl acetate; polyester polymers, polyurethane polymers, polyamide polymers, polyimide polymers, polyol polymers, epoxy polymers, terpene polymers, aliphatic or alicyclic hydrocarbon resins and aromatic petroleum resins. These may be used alone or in combination. Of these, styrene-acrylic copolymer resins, polyester resins and polyol resins are preferable in terms of electrical property, cost, and the like. The polyester resins and polyol resins are even more preferably used because of their excellent toner-fixing properties.

As to the pulverized toner, for example, the resin component is mixed with the above-mentioned colorant component, wax component and charge controlling component in advance as necessary, then they are kneaded at a temperature lower than or equal to a temperature in the vicinity of the melting temperature of the resin component, and then the mixture is cooled and then subjected to a pulverization and classification process, thereby producing the toner; additionally, the above-mentioned externally added component may be suitably added and mixed therewith if necessary.

The developing unit may be of drying developing type or wet developing type, or may be a single-color developing unit or a multi-color developing unit. The developing units include, for example, preferably the ones that have stirrer that friction stirs the toner or the developer to be charged, and a rotatable magnet roller.

In the developing unit, for example, the toner and the carrier are mixed and stirred, the toner is charged due to friction in the process and held in the standing state on the surface of a magnet roller in rotation, thereby forming a magnetic brush. Since this magnet roller is disposed in the vicinity of the image bearing member (photoconductor), a part of the toner that forms the magnetic brush formed on the surface of the magnet roller, is transferred to the surface of the image bearing member (photoconductor) due to an electrical absorption. As a result, the latent electrostatic image is developed with the toner, and then a visible image is formed with the toner on the surface of the image bearing member (photoconductor).

A developer contained in the developing unit is a developer containing the toner, and the developer may be a one-component developer or a two-component developer.

<Transferring Step and Transfer Unit>

The transferring step is a step of transferring a visible image via an intermediate transfer medium or directly to a recording medium. In a preferred aspect, the visible image is transferred to the intermediate transfer medium as a primary transfer, the visible image is then transferred on the recording medium as a secondary transfer. More preferably, using a toner of two or more colors, preferably using a full color toner, the visible image is transferred to the intermediate transfer member to form a multiple-transfer image as the primary transfer, and the multiple-transfer image is transferred to the recording medium as the secondary transfer.

The transferring step is performed by the transfer unit, for example, the visible image is transferred by charging the image bearing member (photoconductor) using a transfer-charger. In a preferred aspect, the transfer unit includes a primary transfer unit configured to transfer the visible image to the intermediate transfer medium to form a multiple-transfer image, and a secondary transfer unit configured to transfer the multiple-transfer image to the recording medium.

The intermediate transfer member is not particularly limited and may be appropriately selected from those known in the art depending on the intended purpose. For example, an intermediate transfer belt is preferable.

The image bearing member may be an intermediate transfer medium used in image formation by a so-called intermediate transfer method in which color visible images formed on photoconductor are primarily transferred so as to be superimposed on top of one another, and then transferred onto a recording medium.

—Intermediate Transfer Medium—

The intermediate transfer medium preferably exhibits conductivity of $1.0\times10^{5}$ Ω·cm to $1.0\times10^{11}$ Ω·cm in volume resistance. When the volume resistance is lower than $1.0\times10^{5}$ Ω·cm, a phenomenon of so-called transfer dust may arise in which visible images become unstable owing to electric discharge, when the visible images are transferred from the photoconductors onto the intermediate transfer medium. When the volume resistance is higher than $1.0\times10^{11}$ Ω·cm, an opposing electric charge to that of a visible image may remain on the intermediate transfer medium and thus an after-image may appear on the next image, after the visible image has been transferred from the intermediate transfer medium onto a recording medium.

For the intermediate transfer medium, a belt-shaped or cylindrical plastic may be used which is produced by kneading a thermoplastic resin together with any one or combination of a metal oxide such as tin oxide or indium oxide, a conductive polymer and a conductive particle such as carbon black and then subjecting the mixture to extrusion molding. Besides, it is possible to obtain an intermediate transfer medium in the form of an endless belt by heating and centrifugally molding a resin solution containing a thermally crosslinkable monomer or oligomer, with the addition of the above-mentioned conductive particle and/or conductive polymer, if necessary.

When the intermediate transfer medium is provided with a surface layer, the materials for the surface layer used in the surface layer of the photoconductor, excluding the charge transporting material, may be used after suitably subjected to resistance adjustment with the use of a conductive material.

The transfer unit, i.e. the primary transfer unit and the secondary transfer unit, preferably has at least a transfer device that is configured to charge so as to separate the visible image formed on the image bearing member (photoconductor) and transfer the visible image onto the recording medium. One transfer unit or two transfer units may be used. Examples of the transfer device include corona transfer devices utilizing corona discharge, transfer belts, transfer rollers, pressure-transfer rollers, and adhesion-transfer devices.

The recording medium is not particularly limited and may be appropriately selected from known recording media, such as standard recording paper, non-standard recording paper, cardboards, postcards, and OHP sheets.

<Protective Layer Forming Step and Protective Layer Forming Unit>

The protective layer forming step is a step of applying the image-bearing member protecting agent of the present invention onto the surface of the image bearing member, from which from which the visible image has been transferred, so as to form a protective layer.

As the protective layer forming unit, the protective layer forming device of the present invention as mentioned hereinbefore can be used.

<Fixing Step and Fixing Unit>

The fixing step is a step of fixing the transferred visible image on a recording medium by means of the fixing device. This step may be carried out for every transfer of individual color toners to the recording medium or carried out at a time in a state where individual color toners are stacked on one another.

The fixing unit is not particularly limited and may be appropriately selected depending on the intended purpose. Preferred is, for example, a known heating and pressuring unit. Examples of the heating and pressuring unit includes a combination of a heating roller with a pressure roller and a combination of a heating roller, a pressure roller and an endless belt.

Preferably, heating by the heating and pressuring unit is usually from 80° C. to 200° C. As a heating system, various heating system including heating using a heater such as an electric heater, a halogen heater, a carbon heater; electromagnetic induction heating using electromagnetic induction; and heating using a heating element such as a thermal head can be used.

In the present invention, a known optical fixing unit can be used with the fixing unit in the fixing step, or instead of the fixing unit in the fixing step, depending on the intended purpose.

The charge eliminating step is a step of applying an antistatic bias to the image bearing member to eliminate charge and can be favorably carried out by the charge eliminating unit.

The charge eliminating unit is not particularly limited as long as it can apply an antistatic bias to the image bearing member, and may be appropriately selected from known charge eliminating units. Preferred is a charge eliminating lamp.

<Cleaning Step and Cleaning Unit>

The cleaning step is a step of removing the toner remaining on the image bearing member and preferably carried out by the cleaning unit (the cleaning unit 4 and the like).

The cleaning unit is preferably located in the downstream from the transfer unit and the upstream from the protective layer forming device, with respect to a movement direction (rotation direction) of the surface of the image bearing member.

The cleaning unit is not particularly limited, as long as it can remove the toner remaining on the image bearing member, and may be appropriately selected from known cleaners. Preferred examples thereof include magnetic brush cleaners, electrostatic brush cleaners, magnetic roller cleaners, blade cleaners, brush cleaners, and web cleaners.

<Recycling Step and Recycling Unit>

The recycling step is a step of recycling the toner, which has been removed by the cleaning step, to the developing unit, and is suitably carried out by a recycling unit.

The recycling unit is not particularly limited. Examples thereof include known conveyance units (a conveyance unit using a coil, screw or the like, a conveyance unit configured to mix with air using a powder pump, an air pump or the like, an electrostatic conveyance unit).

<Controlling Step and Controlling Unit>

The controlling step is a step of controlling each of the above-mentioned steps, and is suitably carried out by a controlling unit.

The controlling unit is not particularly limited, as long as it can control the performance of each unit, and may be appropriately selected depending on the intended purpose. Examples thereof include equipment such as sequencers, and computers.

<Configuration Example of Image Forming Apparatus>

Figure 3:
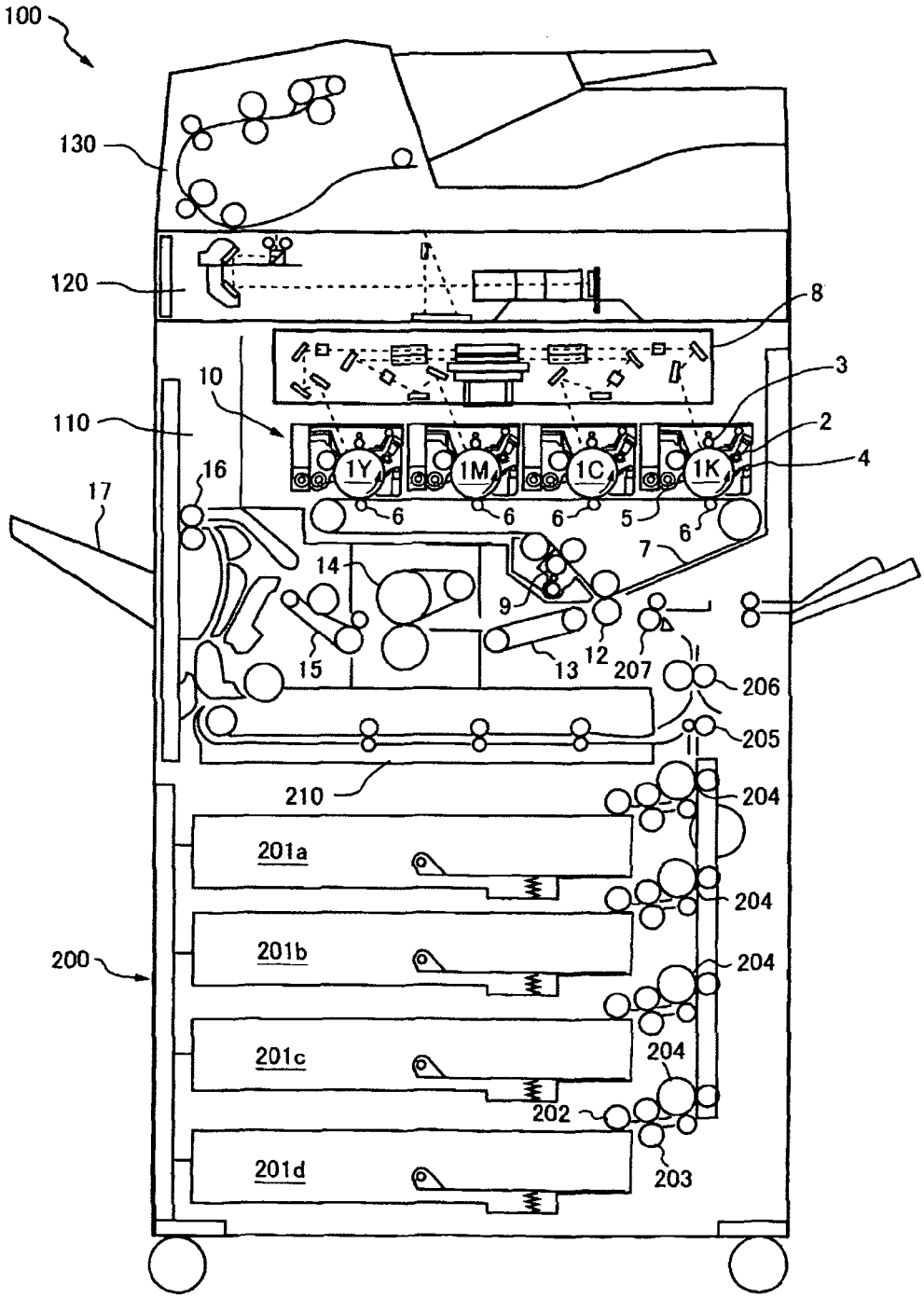
FIG. 3 is a schematic configuration diagram schematically showing a configuration example of an image forming apparatus provided with the protective layer forming device of the present invention.

FIG. 3 is a schematic cross sectional view showing an example of an image forming apparatus 100 provided with the protective layer forming device of the present invention.

The image forming apparatus 100 includes an image forming apparatus body (printer section) 110 for forming an image, a document reading section (scanner section) 120 provided on the image forming apparatus body 110, and an automatic document feeder (ADF) 130 provided on the document reading section 120, a paper feed section 200 provided under the image forming apparatus body 110, and the image forming apparatus 100 has a function of a copier. The image forming apparatus 100 has a communication function with an external device, and can be used as a printer or a scanner by connecting via LAN with a personal computer outside of the apparatus. Moreover, the image forming apparatus 100 is connected with a telephone line or an optical line so as to use as a facsimile.

In the image forming apparatus body 110, four image forming sections (image forming stations) 10 having the same configuration, in which developing units 5 contain different colors of toners are provided next to each other, wherein four images of different colors (for example, yellow (Y), magenta (M), cyan (C) and black (K)) are formed, and visible images of different colors are superimposingly transferred onto a transfer medium or an intermediate transfer medium so as to form a multicolor or full color image. In FIG. 3, four image forming sections 10 are provided along a belt-shaped transfer medium (hereinafter, referred to as an intermediate transfer medium) 7 stretched around a plurality of rollers, and each of the visible images of different colors formed in each of the image forming sections is sequentially superimposingly transferred onto the intermediate transfer medium 7, and then transferred onto a sheet-like recording medium such as paper at one time by a secondary transfer unit 12.

Image forming sections 10 have the same structure as those shown in FIG. 2, protective layer forming devices 2, charging units 3, exposure parts such as laser light from a latent electrostatic image forming unit 8, developing units 5, primary image transfer units 6 and cleaning units 4 are arranged around image bearing members (for example, photoconductor drums) 1Y, 1M, 1C and 1K for respective colors. As in FIG. 2, in each of the image forming sections 10, a process cartridge 11 including the photoconductor 1 together with the protective layer forming device 2, the charging unit 3, the developing unit 5, and a cleaning unit 4 in a cartridge is used. The process cartridge 11 is detachably mounted on the image forming apparatus body 110.

Next, operation of an image forming apparatus shown in FIG. 3 will be described. A process for image formation will be explained with an example of a negative-positive process. Each image forming section operates similarly.

The image bearing members 1Y, 1M, 1C, 1K, each of which is typified by a photoconductor having an organic photoconductive layer (OPC), are subjected to charge elimination by a charge-eliminating lamp (not shown) or the like, then the image bearing members 1Y, 1M, 1C, 1K are negatively charged in a uniform manner by the charging units (for example, charging rollers) 3 having charging members.

When each of the image bearing members 1Y, 1M, 1C, 1K is charged by each of the charging units 3, a voltage of appropriate intensity or a charging voltage obtained by superimposing an AC voltage onto the voltage, which is suitable for charging the image bearing members 1Y, 1M, 1C, 1K to a desired electric potential, is applied from a voltage applying mechanism (not shown) to each of the charging units 3.

On each of the charged image bearing members 1Y, 1M, 1C, 1K, a latent electrostatic image is formed by irradiating with the laser beam from the latent electrostatic image forming unit 8 (the absolute value of the electric potential of the exposed portion is smaller than that of the electric potential of the unexposed portion).

The laser beam is emitted from a semiconductor laser, and the surface of the image bearing members 1Y, 1M, 1C, 1K are scanned in the direction of the rotational shafts (a main scanning direction) of the image bearing members 1Y, 1M, 1C, 1K, using a multifaceted mirror of a polygonal column (polygon mirror) or the like which rotates at high speed.

The thus formed latent electrostatic image is developed with a developer which contains toner particles or a mixture of toner particles and carrier particles, which is supplied onto each of developing sleeves of a developing rollers 51 (the same as shown in FIG. 2) serving as developer bearing members in each of the developing units 5, so as to form a visible image.

When the latent image is developed, a voltage of appropriate intensity or a developing bias obtained by superimposing an AC voltage onto the voltage is applied from a voltage applying mechanism (not shown) to a developing sleeve, with the intensity being between the intensities of the voltages for the exposed portion and the unexposed portion of the image bearing members 1Y, 1M, 1C, 1K.

By the above described operation, visible images corresponding to respective colors formed on image bearing members 1Y, 1M, 1C, 1K are sequentially superimposed and primarily transferred onto the intermediate transfer medium 7 by primary transfer units 6. On the other hand, in synchronized timing with the image forming operation and primary transfer operation, a sheet recording medium such as paper is fed from a paper feed cassette selected from a plurality of paper feed cassettes 201*a*, 201*b*, 201*c*, 201*d* in a paper feed section 200 by a paper feed mechanism consisting of a paper feed roller 202 and a separation roller 203, and then fed to a secondary transfer section via a conveyance rollers 204, 205, 206 and a registration roller 207. In the secondary transfer section, the visible image on the intermediate transfer medium 7 is secondarily transferred onto the recording medium which is conveyed by a secondary transfer unit (such as a secondary transfer roller) 12. In the transferring step, as a transfer bias an electric potential having opposite polarity to charge polarity of the toner is preferably applied to the primary transfer unit 6 and the secondary transfer unit 12.

After the secondary transfer, the recording medium is separated from the intermediate transfer medium 7 so as to obtain a transfer image. Toner particles remaining on each of the photoconductor 1 after the primary transfer is recovered by a cleaning member 41 (the same as shown in FIG. 2) of the cleaning unit 4 to a toner recovery chamber inside the cleaning unit 4. Toner particles remaining on the intermediate transfer medium 7 after the secondary transfer is recovered by a cleaning member of a belt cleaning unit 9 to a toner recovery chamber inside the belt cleaning unit 9.

The image forming apparatus 100 shown in FIG. 3 is a so-called tandem type image forming apparatus using an intermediate transfer system, in which a plurality of the image forming sections 10 are provided along the intermediate transfer medium 7, wherein a plurality of visible images of different colors sequentially formed on photoconductors 1Y, 1M, 1C, 1K in a plurality of the image forming sections 10 are sequentially transferred onto the intermediate transfer medium 7, and then transferred at one time on the recording medium such as paper. Thereafter, the recording medium on which the visible image is transferred is conveyed to a fixing unit 14 by a conveyance unit 13, and then the visible image is fixed thereon by heat and pressure. The recording medium on which the visible image has been fixed is delivered by a conveyance unit 15 and delivery roller 16 to a delivery tray 17. Moreover, the image forming apparatus 100 has a double face printing function, upon double face printing, a conveyance path located downstream from the fixing unit 14 is switched and the recording medium, on which one surface an image is fixed is reversed by a double-sided printing conveyance unit 210, and the recording medium is transferred to the secondary transfer section by the conveyance roller 206 and the registration roller 207 so as to transfer an image on another surface of the recording medium. The recording medium on which the image has been transferred is conveyed to the fixing unit 14 as described above and then the image is fixed on the recording medium, and the recording medium on which the image has been fixed is delivered to the delivery tray 17.

Alternatively, in the above configuration example, the image forming apparatus does not use the intermediate transfer medium, but may be a tandem image forming apparatus using a direct transfer method. In the case of the direct transfer method, the image forming apparatus may use a transfer belt for carrying and conveying the recording medium instead of the intermediate transfer medium, and may have such configuration that visible images of different colors sequentially formed on the photoconductors 1Y, 1M, 1C, 1K in the image forming sections 10 are sequentially transferred directly onto a recording medium such as paper which is conveyed by the transfer belt, and then the recording medium is conveyed to the fixing unit 14 so as to fix the visible image on the recording medium by heat and pressure, etc.

In the above described image forming apparatus, the charging unit 3 is preferably a charging unit, in which a charging member, such as a charging roller, is located in contact with or close to the surface of the image bearing member. This makes it possible to greatly reduce the amount of ozone generated at the time of charging in comparison with corona dischargers using discharge wires, which are so-called corotron and scorotron.

It should, however, be noted that in the charging unit 3 which performs charging with the charging member located in contact with or close to the surface of the image bearing member, since electric discharge is performed in the vicinity of the surface of the image bearing member as described above, the image bearing member is likely to be subjected to high electrical stress. However, by the use of the protective layer forming device 2 utilizing the image-bearing member protecting agent 21 which contains the hydrophobic organic compound (A), the inorganic lubricant (B) and the inorganic fine particles (C) of the present invention, the image bearing member 1 can be maintained without causing degradation over a long period of time; hence, it is possible to greatly reduce the temporal variation in the quality of images and the variation in the quality of images caused by a use environment and thus to secure stable image quality.

As described above, since the image forming apparatus of the present invention has wide acceptable ranges with respect to the variation in the state of the image bearing member surface, and has a configuration in which the variation in charging performance to the image bearing member is highly reduced. Therefore, the image forming apparatus and the above-mentioned toner are used together so as to obtain significantly high quality images in a stable manner for a long period of time.

EXAMPLES

Hereinafter, in an image forming apparatus of the present invention, Examples and Comparative Examples of the case where a protecting agent is applied on a photoconductor as an image bearing member will be described. However, these are not to be construed as limiting the present invention in any way.

Here, Table 1 shows formulations and methods of Examples and Comparative Examples, in the case where the photoconductor was coated with a protecting agent containing a hydrophobic organic compound (A), an inorganic lubricant (B) and inorganic fine particles (C).

By the use of an image forming apparatus (here, IMAGIO MP C3000 (a copier manufactured by Ricoh Company, Ltd.) which had been converted), in which a process cartridge 11 provided with a protective layer forming device 2 was mounted in an image forming section as shown in FIG. 2, the protective layer forming device 2 including a protecting agent supply mechanism corresponding to a protecting agent supply member 22 shown in FIG. 1 and a protective layer forming mechanism 24 was located in the downstream from a cleaning member 4 and the upstream from a charging roller 3, with respect to a rotation direction of a photoconductor 1, so as to apply a protecting agent 21 containing the hydrophobic organic compound (A), the inorganic lubricant (B) and the inorganic fine particles (C) onto the photoconductor 1.

In each of Examples 1 to 6, a protecting agent contained the hydrophobic organic compound (A), the inorganic lubricant (B) and the inorganic fine particles (C) was used, wherein zinc stearate which was one of fatty acid metal salts was used as the hydrophobic organic compound (A), boron nitride was used as the inorganic lubricant (B), and alumina particles or titanium oxide particles were used as the inorganic fine particles (C).

Specifically, in Example 1, alumina particles each having a specific surface area of 2.2 $m^2/g$ were used as the inorganic fine particles (C).

In Example 2, alumina particles each having a specific surface area of 3.1 $m^2/g$ were used as the inorganic fine particles (C).

In Example 3, alumina particles each having a specific surface area of 3.9 $m^2/g$ were used as the inorganic fine particles (C).

In Example 4, alumina particles each having a specific surface area of 5.1 $m^2/g$ were used as the inorganic fine particles (C).

In Example 5, alumina particles each having a specific surface area of 6.5 $m^2/g$ were used as the inorganic fine particles (C).

In Example 6, titanium oxide particles each having a specific surface area of 5.8 $m^2/g$ were used as the inorganic fine particles (C).

In Comparative Example 1, a protecting agent contained the hydrophobic organic compound (A) and the inorganic lubricant (B), without containing the inorganic fine particles (C) was used, wherein zinc stearate which was one of fatty acid metal salts was used as the hydrophobic organic compound (A) and boron nitride was used as the inorganic lubricant (B).

In each of Comparative Examples 2 to 6, zinc stearate which was one of fatty acid metal salts was used as the hydrophobic organic compound (A), boron nitride was used as the inorganic lubricant (B), and alumina particles or titanium oxide particles were used as the inorganic fine particles (C).

Specifically, in Comparative Example 2, alumina particles each having a specific surface area of 1.1 $m^2/g$ were used as the inorganic fine particles (C).

In Comparative Example 3, alumina particles each having a specific surface area of 12.0 $m^2/g$ were used as the inorganic fine particles (C).

In Comparative Example 4, titanium oxide particles each having a specific surface area of 14.0 $m^2/g$ were used as the inorganic fine particles (C).

In Comparative Example 5, titanium oxide particles each having a specific surface area of 11.0 $m^2/g$ were used as the inorganic fine particles (C).

In Comparative Example 6, alumina particles each having a specific surface area of 5.1 $m^2/g$ were used as the inorganic fine particles (C).

The protecting agents of Examples 1 to 6 and Comparative Examples 2 to 6 were formed in such a manner that 85% by mass of the zinc stearate, 10% by mass of the boron nitride, and 5% by mass of the inorganic fine particles (C) were mixed, shaped and solidified, and then used.

In each of Examples 1 to 6 and Comparative Example 2 to 5, the mixed powder was directly loaded into a mold, and compression molded by a pressing machine to be solidified.

Measurement of a specific surface area ($m^2/g$) was performed using a laser scattering Particle Size Distribution Analyzer LA-920 manufactured by HORIBA, Ltd.

Then, the measurements were performed five times, and an average value thereof was obtained, as shown in Table 1.

Using each of the protecting agents of Examples and Comparative Examples, an image output test (continuous paper feed test) was performed twice, in which images were continuously formed on 5,000 sheets of A4 size paper with an image area ratio of 6%. Thereafter, filming on the photoconductor, occurrence of scar on the photoconductor, and smearing on the charging roller were visually evaluated.

Evaluation criteria are as follows:

[Evaluation Criteria of Filming]

A: No smearing occurred.

B: Very little smearing occurred.

C: Smearing occurred but in an allowable level.

D: Smearing occurred in a large area.

[Evaluation Criteria of Occurrence of Scar on Photoconductor]

A: No scar occurred.

B: Very little scar occurred.

C: Scar occurred but in an allowable level.

D: A great number of scars occurred.

[Evaluation Criteria of Smearing on Charging Roller]

A: No smearing occurred.

B: Very little smearing occurred.

C: Smearing occurred but in an allowable level.

D: Smearing occurred in a large area.

TABLE 1

| | (A) | | (B) | | (C) | | | | |
|---|---|---|---|---|---|---|---|---|---|
| | Hydrophobic organic compound | % by mass | Inorganic lubricant | % by mass | Inorganic fine particles | Trade name | Specific surface area ($m^2/g$) | % by mass | Method |
| Ex. 1 | zinc stearate | 85 | boron nitride | 10 | alumina | AA-07 | 2.2 | 5 | Compression molding |
| Ex. 2 | | | | | | AA-05 | 3.1 | | |
| Ex. 3 | | | | | | AA-04 | 3.9 | | |
| Ex. 4 | | | | | | AA-03 | 5.1 | | |
| Ex. 5 | | | | | | AKP-3000 | 6.5 | | |
| Ex. 6 | | | | | titanium oxide | HT1504 | 5.8 | | |
| Comp. Ex. 1 | | 90 | | | — | — | — | — | |
| Comp. Ex. 2 | | 85 | | | alumina | AA-1.5 | 1.1 | 5 | |
| Comp. Ex. 3 | | | | | | AKP-50 | 12.0 | | |
| Comp. Ex. 4 | | | | | titanium oxide | HT130R | 14.0 | | |
| Comp. Ex. 5 | | | | | | HT13111 | 11.0 | | |
| Comp. Ex. 6 | | | | | alumina | AA-03 | 5.1 | | melting and molding |

In Comparative Example 6, the mixed powder was melted and then filled in a mold (melted and cast molded), and then solidified.

Under the above test conditions, the zinc stearate manufactured by NOF CORPORATION was used.

The boron nitride manufactured by MIZUSHIMA FERROALLOY CO., LTD. was used.

The alumina particles manufactured by Sumitomo Chemical Co., Ltd were used.

The titanium oxide particles manufactured by TOHO TITANIUM CO., LTD. was used.

TABLE 2

| | Filming on photoconductor | Scar on photoconductor | Smearing on charging roller |
|---|---|---|---|
| Example 1 | B | C | C |
| Example 2 | B | B | B |
| Example 3 | B | B | B |
| Example 4 | A | A | A |
| Example 5 | C | C | C |
| Example 6 | B | B | B |
| Comparative Example 1 | D | A | A |

TABLE 2-continued

| | Filming on photoconductor | Scar on photoconductor | Smearing on charging roller |
|---|---|---|---|
| Comparative Example 2 | D | B | D |
| Comparative Example 3 | D | D | D |
| Comparative Example 4 | D | C | C |
| Comparative Example 5 | D | C | C |
| Comparative Example 6 | D | C | D |

It is inferred that the image-bearing member protecting agent of the present invention makes it possible to prevent the filming on the image bearing member, the occurrence of a scar on the image bearing member and the smearing on the charging member for the following reasons.

The image-bearing member protecting agent is applied to the image bearing member in an electrophotographic image forming apparatus in order to protect the image bearing member from hazards at the times of charging and cleaning. However, a fatty acid metal salt, i.e. the hydrophobic organic compound (A), generally used for the image-bearing member protecting agent decreases in lubricating property as affected by charging, and thus toner and the protecting agent pass through a gap between the cleaning member and the surface of the image bearing member, and then fly and adhere to the charging member, thus causing smearing on the charging member.

Thus, the inorganic lubricant (B) is added in the protecting agent to assist lubricity, thereby preventing the toner or the protecting agent from passing through the gap, and to reduce the amount of the hydrophobic organic compound (A) flying and adhering to the charging member.

However, when only the hydrophobic organic compound (A) and the inorganic lubricant (B) are added in the protecting agent, the protecting agent is hard to be removed from the surface of the image bearing member using the cleaning member, due to high lubricity between the image bearing member and the cleaning member. The lubricant adheres onto the image bearing member, causing the filming.

In addition to the hydrophobic organic compound (A) and the inorganic lubricant (B), the inorganic fine particles (C) are added in the protecting agent, so that the inorganic lubricant (B) can be removed by the inorganic fine particles (C). Therefore, no filming occurs on the image bearing member.

However, when the inorganic fine particles (C) have a high specific surface area and angular shape, the inorganic fine particles (C) are strongly grinded, causing a scar or streak on the image bearing member.

On the other hand, when the inorganic fine particles (C) have a low specific surface area and close to spherical shape, it has a small grinding force. The protecting agent is hard to be removed from the surface of the image bearing member using the cleaning member, due to high lubricity between the image bearing member and the cleaning member. The lubricant adheres on the image bearing member, causing the filming.

As in Examples 1 to 6, the image-bearing member protecting agent obtained by adding the inorganic fine particles (C) each having a specific surface area of 2.0 $m^2/g$ to 6.5 $m^2/g$ in the hydrophobic organic compound (A) and the inorganic lubricant (B) is used and applied or adhered to the surface of the image bearing member, so that the inorganic lubricant (B) can be removed without leaving a scar on the image bearing member, and prevent the filming on the image bearing member.

Here, in the present invention, as in Examples 1 to 6, the image-bearing member protecting agent containing the hydrophobic organic compound (A), the inorganic lubricant (B) and the inorganic fine particles (C) each having a specific surface area of 2.0 $m^2/g$ to 6.5 $m^2/g$ is applied or adhered to the surface of the image bearing member, so as to prevent the filming on the image bearing member, the occurrence of a scar on the image bearing member, and the smearing on the charging member.

On the other band, as in Comparative Example 1, when the image-bearing member protecting agent only contains the hydrophobic organic compound (A) and the inorganic lubricant (B), the image-bearing member protecting agent secures high lubricity. Thus, the lubricity is not decreased even though it is affected by charging, and the toner dose not pass through the cleaning member, and not fly to the charging member, thereby causing no smearing on the charging member.

However, when only the hydrophobic organic compound (A) and the inorganic lubricant (B) are added in the protecting agent, the protecting agent is hard to be removed from the surface of the image bearing member using the cleaning member due to high lubricity between the image bearing member and the cleaning member. The lubricant adheres onto the image bearing member, causing the filming.

As in Comparative Example 2, when the inorganic fine particles (C) each having a specific surface area of less than 2.0 $m^2/g$ is used, the particles have a close to spherical shape, obtaining small grinding effect. Moreover, the inorganic fine particles (C) have very small contact areas with the inorganic lubricant (B), a toner base and a toner additive, which are adhered onto the surface of the image bearing member.

Therefore, the inorganic lubricant (B), the toner base, and the toner additive remain on the surface of the image bearing member, causing the filming.

As in Comparative Examples 3 to 5, when the inorganic fine particles (C) each having a specific surface area of 10.0 $m^2/g$ or more, the particles have a nonspherical shape, causing less fluidity and an excessively strong grinding force.

Thus, the lubricant on the image bearing member (photoconductor) is excessively scraped, leaving a scar on the image bearing member (photoconductor). Moreover, because the amount of the lubricant is not enough to protect the photoconductor, the filming occurs. Further more, because the amount of the lubricant is not enough to prevent the toner from passing through the cleaning blade, the smearing on the charging roller occurs.

In the present invention, the hydrophobic organic compound (A) is a material having a lamella crystal, and is a fatty acid metal salt. As in each of Examples 1 to 6, the surface of the image bearing member is relatively uniformly coated with the protecting agent using zinc stearate as the hydrophobic organic compound (A), so that an excellent protecting properties from the electrical stress is obtained in the charging step. Moreover, the material having a lamella crystal has a layer structure in which amphipatic molecules are self-organized, and the crystal breaks along an interlayer by a shearing force, so as to be slippery. Thus, the material has excellent lubricity. The fatty acid metal salt, particularly zinc stearate is used in many electrophotographic apparatuses.

In the present invention, the inorganic lubricant (B) is a two dimensional layer structure, and the inorganic lubricant (B) contains at least one selected from the group consisting of talc, mica, boron nitride, kaolin, plate-shaped alumina, sericite, molybdenum disulfide, tungsten disulfide, montmorillonite, calcium fluoride and graphite. As in each of Examples 1 to 6, the inorganic lubricant having a two dimensional layer structure improves the lubricity between the image bearing member and the cleaning member, so that the toner and the protecting agent do not pass through therebetween. Thus, the inorganic lubricant can prevent smearing on the charging member.

In the specification, the two dimensional layer structure means a laminated structure in which a layer is formed by metallic bonding, covalent bonding, or ionic bonding, and the layers are bonded only by Van der Waals force.

In the present invention, the inorganic fine particles (C) each having a specific surface area of 2.0 $m^2/g$ to 6.5 $m^2/g$ is at least one selected from the group consisting of silica, alumina, titanium oxide, zirconium oxide, magnesium oxide, ferrite, and magnetite. By the use of silica, alumina, titanium oxide, zirconium oxide, magnesium oxide, ferrite, or magnetite, particles having a uniform and small particle diameter can be produced at low cost, and the filming can be prevented. Particularly, alumina has excellent properties as an abrasive, and is used in many industrial fields.

In the case where the protecting agent is formed by adding the inorganic lubricant (B) and the inorganic fine particles (C) to zinc stearate as the hydrophobic organic compound (A), as in Comparative Example 6, when the protecting agent is formed by cast molding in which a melted lubricant is filled in a mold, the molded solid becomes excessively hard, and cannot be supplied via the brush roller to the image bearing member. As a result, the photoconductor cannot be protected, the filming occurs thereon, and a large amount of toner passes through the blade, causing the smearing on the charging member.

Thus, in the present invention, as in each of Examples 1 to 6, the powder of the protecting agent is solidified by compression molding, so that the protecting agent is adjusted to have any strength and can be supplied to the image bearing member.

A generally used molded protecting agent is produced by cast molding method, in which a melted fatty acid metal salt is filled in a mold. Thus, problems occur, such as rise in cost, consideration to environment, and the like. In contrast, the molded protecting agent solidified by compression can reduce production cost or production energy.

Since the image-bearing member protecting agent of the present invention exhibits protective effect by adhering onto the surface of the image bearing member and then forming a film, it can be relatively plastic deformed. Therefore, when a block shaped image-bearing member protecting agent component is directly pressed to the surface of the image bearing member so as to form a protective layer, the protecting agent is excessively supplied thereto and the protective layer is not efficiently formed. Moreover, the protective layer is formed into a multilayer structure, which may block light transmission in the exposing step for forming a latent electrostatic image. Therefore, the types of the image-bearing member protecting agents to be used are limited.

However, the protective layer forming device of the present invention is so configured as in FIGS. 1 and 2 that the image-bearing member protecting agent 21 is supplied via the protecting agent supply member 22 to the image bearing member 1. As a result, the protecting agent can be uniformly supplied to the surface of the image bearing member, even when a soft image-bearing member protecting agent is used.

When the protective layer forming mechanism 24, which presses the image-bearing member protecting agent 21 so as to form a layer, is provided in the protective layer forming device 2, a layer forming member 24*a* such as a blade may also serve as a cleaning member. To surely form the protective layer, it is preferred that the residue mainly containing toner on the image bearing member be removed beforehand by the cleaning member 41 of the cleaning unit 4, so as not to prevent the residue from being contained in the protective layer as shown in FIGS. 1 and 2.

In the present invention, the image forming method using the protective layer forming device 2 having the image-bearing member protecting agent 21 can suppress excessively high lubricity between the image bearing member and the cleaning member, and can prevent the cleaning member from wearing caused by the toner and its additive. Since a certain degree of high lubricity is secured, charging does not affect decrease in the lubricity, and the toner or the protecting agent does not pass through the cleaning blade, thereby causing no flying to the charging member. Therefore, the smearing on the charging member never occurs. As a result, the smearing on the charging member, the filming (contaminant, attachment), and blade wear can be prevented simultaneously.

In the present invention, as shown in FIGS. 1 to 3, the image forming apparatus is constituted with the protective layer forming device 2 having the image-bearing member protecting agent 21, so that the image bearing member 1 such as a photoconductor can continuously use for a long period of time without being replaced.

Particularly, when the image bearing member contains a thermosetting resin in the outermost surface layer thereof, the image-bearing member protecting agent can protect the image bearing member from being deteriorated by electrical stress caused by the charging member, and thus the image-bearing member protecting agent allow the image bearing member containing the thermosetting resin to continuously provide long durability against mechanical stress applied thereon.

The charging unit located in contact with or close to the surface of the image bearing member is influenced by larger electrical stress because a discharge region exists extremely close to the image bearing member. However, the image forming apparatus in which a protective layer is formed on the image bearing member of the present invention can be used without exposing the image bearing member to the electrical stress.

Also, since change in the state of the surface of the image bearing member can be minimized due to the effects of the protective layer formed thereon, it is possible to perform stable cleaning for a long period of time even in the case of using toner of great circularity or toner having a small average particle diameter, in which the quality of cleaning greatly varies depending upon change in the state of the surface of the image bearing member.

Moreover, the protecting agent can improve a water contact angle of the surface of the image bearing member so as to keep the surface of the image bearing member water repellent. Thus, the protecting agent prevents water absorption into the surface of the image bearing member, and suppresses occurrence of image blur.

In the present invention, as shown in FIG. 2, by constituting a process cartridge 11 using the protective layer forming device 2 which includes the image-bearing member protecting agent 21, it is possible to greatly lengthen the period of time for which the process cartridge can be used without being replaced. Thus, the running cost is reduced and the amount of waste is greatly reduced.

Particularly, when the image bearing member contains a thermosetting resin in the outermost surface layer thereof, the image-bearing member protecting agent can protect the image bearing member from being deteriorated by electrical stress caused by the charging member, and thus the image-bearing member protecting agent allow the image bearing member containing the thermosetting resin to continuously provide long durability against mechanical stress applied thereon.

Moreover, as described above, the image bearing member protecting component of the present invention contains virtually no metal component, so that the charging unit located in contact with or close to the surface of the image bearing member is not smeared with a metal oxide or the like, and thus the charging unit less changes over time.

Therefore, the members constituting the process cartridge, such as the image bearing member, the charging member, or the like can easily reuse, and the amount of waste can be further reduced.

In the present invention, as the image forming apparatus shown in FIG. 3, at least one of the process cartridge 11 (the same as shown in FIG. 2) is provided or are provided next to each other in the image forming section 10 so as to achieve an image forming apparatus which can form monochrome, multicolor, or color images with excellent quality in a stable manner for a long period of time.

What is claimed is:

1. An image-bearing member protecting agent comprising:
a hydrophobic organic compound (A);
an inorganic lubricant (B); and
inorganic fine particles (C),
wherein each of the inorganic fine particles (C) has a specific surface area of 2.0 $m^2/g$ to 6.5 $m^2/g$.

2. The image-bearing member protecting agent according to claim 1, wherein the hydrophobic organic compound (A) is a material having a lamella crystal.

3. The image-bearing member protecting agent according to claim 1, wherein the hydrophobic organic compound (A) is a metal salt of fatty acid.

4. The image-bearing member protecting agent according to claim 1, wherein the inorganic lubricant (B) forms a two dimensional layer structure.

5. The image-bearing member protecting agent according to claim 1, wherein the inorganic lubricant (B) contains at least one selected from the group consisting of talc, mica, boron nitride, kaolin, plate-shaped alumina, sericite, molybdenum disulfide, tungsten disulfide, montmorillonite, calcium fluoride and graphite.

6. The image-bearing member protecting agent according to claim 1, wherein the inorganic fine particles (C) are at least one selected from the group consisting of silica, alumina, titanium oxide, zirconium oxide, magnesium oxide, ferrite, and magnetite.

7. The image-bearing member protecting agent according to claim 1, wherein the image-bearing member protecting agent is a solid formed by compression molding.

8. A protective layer forming device comprising:
a unit configured to apply an image-bearing member protecting agent onto a surface of an image bearing member so as to form a protective layer,
wherein the image-bearing member protecting agent comprises:
a hydrophobic organic compound (A);
an inorganic lubricant (B); and
inorganic fine particles (C),
wherein each of the inorganic fine particles (C) has a specific surface area of 2.0 $m^2/g$ to 6.5 $m^2/g$.

9. An image forming method comprising:
forming a latent electrostatic image on an image bearing member;
developing the latent electrostatic image using a toner so as to form a visible image;
transferring the visible image formed on the image bearing member to a transfer medium; and
applying an image-bearing member protecting agent onto a surface of the image bearing member, from which the visible image has been transferred to the transfer medium, so as to form a protective layer thereon,
wherein the image-bearing member protecting agent comprises:
a hydrophobic organic compound (A);
an inorganic lubricant (B); and
inorganic fine particles (C),
wherein each of the inorganic fine particles (C) has a specific surface area of 2.0 $m^2/g$ to 6.5 $m^2/g$.

10. An image forming apparatus comprising:
an image bearing member;
a latent electrostatic image forming unit configured to form a latent electrostatic image on the image bearing member;
a developing unit configured to develop the latent electrostatic image using a toner so as to form a visible image;
a transfer unit configured to transfer the visible image formed on the image bearing member to a transfer medium; and
a protective layer forming device configured to apply a image-bearing member protecting agent onto a surface of the image bearing member, from which the visible image has been transferred to the transfer medium, so as to form a protective layer thereon,
wherein the image-bearing member protecting agent comprises:
a hydrophobic organic compound (A);
an inorganic lubricant (B); and
inorganic fine particles (C),
wherein each of the inorganic fine particles (C) has a specific surface area of 2.0 $m^2/g$ to 6.5 $m^2/g$.

11. The image forming apparatus according to claim 10, further comprising a cleaning unit located in a downstream from the transfer unit and an upstream from the protective layer forming device, with respect to the movement direction of the surface of the image bearing member, and configured to be rubbed against the surface of the image bearing member so as to remove the toner remaining thereon.

12. The image forming apparatus according to claim 10, wherein the image bearing member contains a thermosetting resin at least in the outermost surface layer thereof.

13. The image forming apparatus according to claim 10, further comprising a charging unit located in contact with or close to the surface of the image bearing member.

14. The image forming apparatus according to claim 13, wherein the charging unit comprises a voltage applying unit configured to apply a voltage which includes an AC component.

15. The image forming apparatus according to claim 10, wherein the toner has a circularity SR, represented by Equation 1, in the range of 0.93 to 1.00:

$$\text{Circularity } SR = \text{Circumferential length of a circle having the same area as projected particle area} / \text{Circumferential length of projected particle image} \quad \text{Equation 1.}$$

16. The image forming apparatus according to claim 10, wherein a ratio (D4/D1) of the mass average particle diameter D4 of the toner to a number average particle diameter D1 of the toner is in the range of 1.00 to 1.40.

17. A process cartridge integrally comprising:

an image bearing member; and a protective layer forming device configured to apply an image-bearing member protecting agent onto a surface of the image bearing member, wherein the image-bearing member protecting agent comprises:

a hydrophobic organic compound (A);

an inorganic lubricant (B); and inorganic fine particles (C), wherein each of the inorganic fine particles (C) has a specific surface area of 2.0 $m^2/g$ to 6.5 $m^2/g$.

18. The process cartridge according to claim 17, further comprising a cleaning unit located in an upstream from the protective layer forming device, with respect to a movement direction of the surface of the image bearing member, and configured to be rubbed against the surface of the image bearing member so as to remove a toner remaining thereon.

19. The process cartridge according to claim 17, wherein the image bearing member contains a thermosetting resin at least in the outermost surface layer thereof.

20. The process cartridge according to claim 17, further comprising a charging unit located in contact with or close to the surface of the image bearing member.

* * * * *